US010822986B2

(12) United States Patent
Snider et al.

(10) Patent No.: US 10,822,986 B2
(45) Date of Patent: Nov. 3, 2020

(54) UNITARY BODY TURBINE SHROUDS INCLUDING INTERNAL COOLING PASSAGES

(71) Applicant: General Electric Company, Schenectady, NY (US)

(72) Inventors: Zachary John Snider, Simpsonville, SC (US); David Wayne Weber, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 48 days.

(21) Appl. No.: 16/263,548

(22) Filed: Jan. 31, 2019

(65) Prior Publication Data

US 2020/0248558 A1 Aug. 6, 2020

(51) Int. Cl.
*F01D 11/08* (2006.01)
*F01D 25/12* (2006.01)

(52) U.S. Cl.
CPC ..... *F01D 11/08* (2013.01); *F01D 25/12* (2013.01); *F05D 2240/11* (2013.01); *F05D 2240/14* (2013.01); *F05D 2240/307* (2013.01); *F05D 2260/20* (2013.01)

(58) Field of Classification Search
CPC ..... F01D 11/08; F01D 25/12
See application file for complete search history.

(56) References Cited

U.S. PATENT DOCUMENTS 4,149,824 A 4/1979 Adamson
4,529,355 A * 7/1985 Wilkinson ..... F01D 9/04 415/173.1
4,573,865 A * 3/1986 Hsia ..... F01D 5/187 165/109.1
6,059,523 A 5/2000 Modafferi et al.
6,575,694 B1 6/2003 Thompson et al.
(Continued)

FOREIGN PATENT DOCUMENTS

DE 1223496 A1 1/1994
WO 2015094422 A1 6/2015

OTHER PUBLICATIONS

U.S. Appl. No. 16/263,430, Office Action dated Jul. 13, 2020, 14 pages.

*Primary Examiner* — Woody A Lee, Jr.

(74) *Attorney, Agent, or Firm* — James Pemrick; Hoffman Warnick LLC

(57) ABSTRACT

Turbine shrouds including internal cooling passages are disclosed. The shrouds may include a unitary body including a support portion, an intermediate portion formed integral with and extending from the support portion, and a seal portion formed integral with the intermediate portion, opposite the support portion. The unitary body may also include two opposing slash faces extending between the support portion and the seal portion, a HGP seal slot formed on each of the two opposing slash faces, and at least one plenum and cooling passage extending through the support portion, intermediate portion, and/or the seal portion. The unitary body may also include an exhaust channel and slash face exhaust holes formed in each of the two opposing slash faces. The exhaust channel may be in fluid communication with the cooling passage(s), and the slash face exhaust holes may be in fluid communication with the exhaust channel.

20 Claims, 17 Drawing Sheets

(56) References Cited

U.S. PATENT DOCUMENTS

| | | | | |
|---|---|---|---|---|
| 6,779,597 | B2 | 8/2004 | DeMarche et al. | |
| 6,841,402 | B1 | 1/2005 | Hirayanagi | |
| 6,913,436 | B2 | 7/2005 | McMillan et al. | |
| 6,932,566 | B2 | 8/2005 | Suzumura et al. | |
| 7,011,493 | B2 * | 3/2006 | Marchi | F01D 9/04 415/116 |
| 7,306,424 | B2 | 12/2007 | Romanov et al. | |
| 7,597,533 | B1 | 10/2009 | Liang | |
| 8,353,663 | B2 * | 1/2013 | Arzel | F01D 25/12 415/115 |
| 8,814,507 | B1 | 8/2014 | Campbell et al. | |
| 9,404,379 | B2 | 8/2016 | Mishra | |
| 9,611,754 | B2 | 4/2017 | Taylor | |
| 9,689,276 | B2 | 6/2017 | Lefebvre et al. | |
| 10,077,680 | B2 * | 9/2018 | Thibodeau | F01D 11/08 |
| 2005/0281663 | A1 * | 12/2005 | Trindade | F01D 5/18 415/1 |
| 2009/0214352 | A1 * | 8/2009 | Ochiai | F01D 5/288 416/241 R |
| 2010/0111670 | A1 * | 5/2010 | Shapiro | F01D 11/08 415/115 |
| 2013/0156550 | A1 | 6/2013 | Franks et al. | |
| 2013/0156556 | A1 | 6/2013 | Franks et al. | |
| 2013/0192257 | A1 | 8/2013 | Horine et al. | |
| 2016/0333741 | A1 * | 11/2016 | Stapleton | F01D 25/14 |
| 2017/0107837 | A1 | 4/2017 | Huizenga et al. | |
| 2017/0268359 | A1 * | 9/2017 | Frey | F01D 11/02 |
| 2017/0314414 | A1 | 11/2017 | Lefebvre et al. | |
| 2017/0342910 | A1 | 11/2017 | Snider et al. | |
| 2018/0100409 | A1 * | 4/2018 | Cochet | F01D 25/14 |
| 2018/0238188 | A1 | 8/2018 | Shoemaker et al. | |
| 2018/0364399 | A1 | 12/2018 | Smoke et al. | |
| 2020/0025026 | A1 | 1/2020 | Packer et al. | |

* cited by examiner

UNITARY BODY TURBINE SHROUDS INCLUDING INTERNAL COOLING PASSAGES

CROSS-REFERENCE TO RELATED APPLICATION

This application is related to co-pending U.S. application Ser Nos. 16/263,430 and 16/263,596, filed concurrently, currently pending, and are hereby incorporated by reference in their entirety.

BACKGROUND OF THE INVENTION

The disclosure relates generally to a turbine system component, and more particularly, to a unitary body turbine shrouds for turbine systems that include internal cooling passages formed therein.

Conventional turbomachines, such as gas turbine systems, generate power for electric generators. In general, gas turbine systems generate power by passing a fluid (e.g., hot gas) through a turbine component of the gas turbine system. More specifically, inlet air may be drawn into a compressor to be compressed. Once compressed, the inlet air is mixed with fuel to form a combustion product, which may be reacted by a combustor of the gas turbine system to form the operational fluid (e.g., hot gas) of the gas turbine system. The fluid may then flow through a fluid flow path for rotating a plurality of rotating blades and rotor or shaft of the turbine component for generating the power. The fluid may be directed through the turbine component via the plurality of rotating blades and a plurality of stationary nozzles or vanes positioned between the rotating blades. As the plurality of rotating blades rotate the rotor of the gas turbine system, a generator, coupled to the rotor, may generate power from the rotation of the rotor.

To improve operational efficiencies turbine components may include hot gas path components, such as turbine shrouds and/or nozzle bands, to further define the flow path of the operational fluid. Turbine shrouds, for example, may be positioned radially adjacent rotating blades of the turbine component and may direct the operational fluid within the turbine component and/or define the outer bounds of the fluid flow path for the operational fluid. During operation, turbine shrouds may be exposed to high temperature operational fluids flowing through the turbine component. Over time and/or during exposure, the turbine shrouds may undergo undesirable thermal expansion. The thermal expansion of turbine shrouds may result in damage to the shrouds and/or may not allow the shrouds to maintain a seal within the turbine component for defining the fluid flow path for the operational fluid. When the turbine shrouds become damaged or no longer form a satisfactory seal within the turbine component, the operational fluid may leak from the flow path, which in turn reduces the operational efficiency of the turbine component and the entire turbine system.

To minimize thermal expansion, turbine shrouds are typically cooled. Conventional processes for cooling turbine shrouds include film cooling and impingement cooling. Film cooling involves the process of flowing cooling air over the surfaces of the turbine shroud during operation of the turbine component. Impingement cooling utilizes holes or apertures formed through the turbine shroud to provide cooling air to various portions of the turbine shroud during operation.

Each of these cooling processes create issues during operation of the turbine component. For example, the cooling air utilized in film cooling may mix with the operational fluid flowing through the fluid flow path, and may cause turbulence within the turbine component. Additionally, turbine shrouds often have patterned surfaces that may improve sealing with the rotor during operation. However, the patterned surfaces are not usually conducive with film cooling processes for cooling the shroud. With respect to impingement cooling, in order to form impingement holes or apertures through various portions of the turbine shroud, the turbine shroud must be formed from multiple pieces that must be assembled and/or secured together prior to being installed into the turbine component. As the number of pieces assembled to form the turbine shroud increases, so may the likelihood of possible uncoupling and/or damage to the turbine shroud and/or the turbine component.

BRIEF DESCRIPTION OF THE INVENTION

A first aspect of the disclosure provides a turbine shroud for a turbine system. The turbine shroud includes: a unitary body including: a support portion coupled directly to a turbine casing of the turbine system; an intermediate portion integral with and extending away from the support portion; a seal portion integral with the intermediate portion, opposite the support portion, the seal portion including a forward end, an aft end positioned opposite the forward end, and a hot gas path (HGP) surface extending between the forward end and aft end; two opposing slash faces extending adjacent to and between the support portion and the HGP surface of the seal portion, the two opposing slash faces positioned opposite one another; a hot gas path (HGP) seal slot formed on each of the two opposing slash faces; at least one inlet opening formed in the support portion; at least one plenum in fluid communication with the at least one inlet opening, the at least one plenum extending through the support portion and the intermediate portion; a first cooling passage extending through the seal portion, between the forward end and the aft end of the seal portion, the first cooling passage positioned between the at least one plenum and the HGP surface of the seal portion, and the first cooling passage in fluid communication with the at least one plenum; an exhaust channel formed in each of the two opposing slash faces, between the support portion and the HGP seal slot, the exhaust channel in fluid communication with the first cooling passage; and a plurality of slash face exhaust holes formed in each of the two opposing slash faces, between the HGP surface of the seal portion and the HGP seal slot, the plurality of slash face exhaust holes in fluid communication with the exhaust channel.

A second aspect of the disclosure provides a turbine system including: a turbine casing; a rotor extending axially through the turbine casing; a plurality of turbine blades positioned circumferentially about and extending radially from the rotor; and a plurality of turbine shrouds directly coupled to the turbine casing and positioned radially between the turbine casing and the plurality of turbine blades, each of the plurality of turbine shrouds including: a unitary body including: a support portion coupled directly to the turbine casing; an intermediate portion integral with and extending radially from the support portion; a seal portion integral with the intermediate portion, radially opposite the support portion, the seal portion including a forward end, an aft end positioned opposite the forward end, and a hot gas path (HGP) surface extending between the forward end and aft end; two opposing slash faces extending adjacent to and radially between the support portion and the HGP surface of the seal portion, the two opposing slash faces positioned opposite one another; a hot gas path (HGP) seal slot formed on each of the two opposing slash faces; at least one inlet opening formed in the support portion; at least one plenum in fluid communication with the at least one inlet opening, the at least one plenum extending radially through the support portion and the intermediate portion; a first cooling passage extending through the seal portion, between the forward end and the aft end of the seal portion, the first cooling passage positioned radially between the at least one plenum and the HGP surface of the seal portion, and the first cooling passage in fluid communication with the at least one plenum; an exhaust channel formed in each of the two opposing slash faces, radially between the support portion and the HGP seal slot, the exhaust channel in fluid communication with the first cooling passage; and a plurality of slash face exhaust holes formed in each of the two opposing slash faces, radially between the HGP surface of the seal portion and the HGP seal slot, the plurality of slash face exhaust holes in fluid communication with the exhaust channel.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

Figure 1:
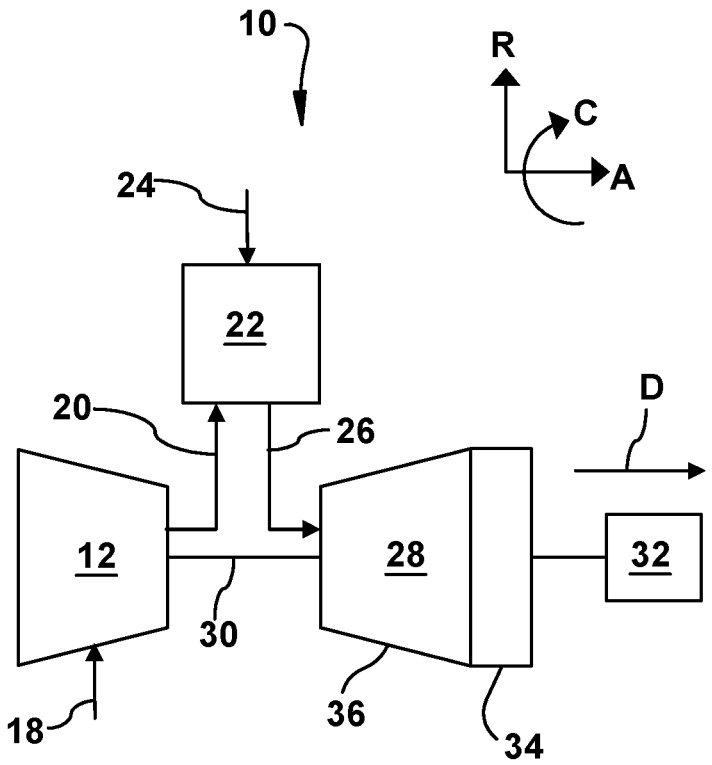
FIG. 1 shows a schematic diagram of a gas turbine system, according to embodiments of the disclosure.

As an initial matter, in order to clearly describe the current disclosure it will become necessary to select certain terminology when referring to and describing relevant machine components within the scope of this disclosure. When doing this, if possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine engine or, for example, the flow of air through the combustor or coolant through one of the turbine's component systems. The term "downstream" corresponds to the direction of flow of the fluid, and the term "upstream" refers to the direction opposite to the flow. The terms "forward" and "aft," without any further specificity, refer to directions, with "forward" referring to the front or compressor end of the engine, and "aft" referring to the rearward or turbine end of the engine. Additionally, the terms "leading" and "trailing" may be used and/or understood as being similar in description as the terms "forward" and "aft," respectively. It is often required to describe parts that are at differing radial, axial and/or circumferential positions. The "A" axis represents an axial orientation. As used herein, the terms "axial" and/or "axially" refer to the relative position/direction of objects along axis A, which is substantially parallel with the axis of rotation of the turbine system (in particular, the rotor section). As further used herein, the terms "radial" and/or "radially" refer to the relative position/direction of objects along a direction "R" (see, FIGS. 1 and 2), which is substantially perpendicular with axis A and intersects axis A at only one location. Finally, the term "circumferential" refers to movement or position around axis A (e.g., direction "C").

As indicated above, the disclosure relates generally to a turbine system component, and more particularly, to a unitary body turbine shrouds for turbine systems that include internal cooling passages formed therein.

These and other embodiments are discussed below with reference to FIGS. 1-17. However, those skilled in the art will readily appreciate that the detailed description given herein with respect to these Figures is for explanatory purposes only and should not be construed as limiting.

FIG. 1 shows a schematic view of an illustrative gas turbine system 10. Gas turbine system 10 may include a compressor 12. Compressor 12 compresses an incoming flow of air 18. Compressor 12 delivers a flow of compressed air 20 to a combustor 22. Combustor 22 mixes the flow of compressed air 20 with a pressurized flow of fuel 24 and ignites the mixture to create a flow of combustion gases 26. Although only a single combustor 22 is shown, gas turbine system 10 may include any number of combustors 22. The flow of combustion gases 26 is in turn delivered to a turbine 28, which typically includes a plurality of turbine blades including airfoils (see, FIG. 2) and stator vanes (see, FIG. 2). The flow of combustion gases 26 drives turbine 28, and more specifically the plurality of turbine blades of turbine 28, to produce mechanical work. The mechanical work produced in turbine 28 drives compressor 12 via a rotor 30 extending through turbine 28, and may be used to drive an external load 32, such as an electrical generator and/or the like.

Gas turbine system 10 may also include an exhaust frame 34. As shown in FIG. 1, exhaust frame 34 may be positioned adjacent to turbine 28 of gas turbine system 10. More specifically, exhaust frame 34 may be positioned adjacent to turbine 28 and may be positioned substantially downstream of turbine 28 and/or the flow of combustion gases 26 flowing from combustor 22 to turbine 28. As discussed herein, a portion (e.g., outer casing) of exhaust frame 34 may be coupled directly to an enclosure, shell, or casing 36 of turbine 28.

Subsequent to combustion gases 26 flowing through and driving turbine 28, combustion gases 26 may be exhausted, flow-through and/or discharged through exhaust frame 34 in a flow direction (D). In the non-limiting example shown in FIG. 1, combustion gases 26 may flow through exhaust frame 34 in the flow direction (D) and may be discharged from gas turbine system 10 (e.g., to the atmosphere). In another non-limiting example where gas turbine system 10 is part of a combined cycle power plant (e.g., including gas turbine system and a steam turbine system), combustion gases 26 may discharge from exhaust frame 34, and may flow in the flow direction (D) into a heat recovery steam generator of the combined cycle power plant.

Figure 2:
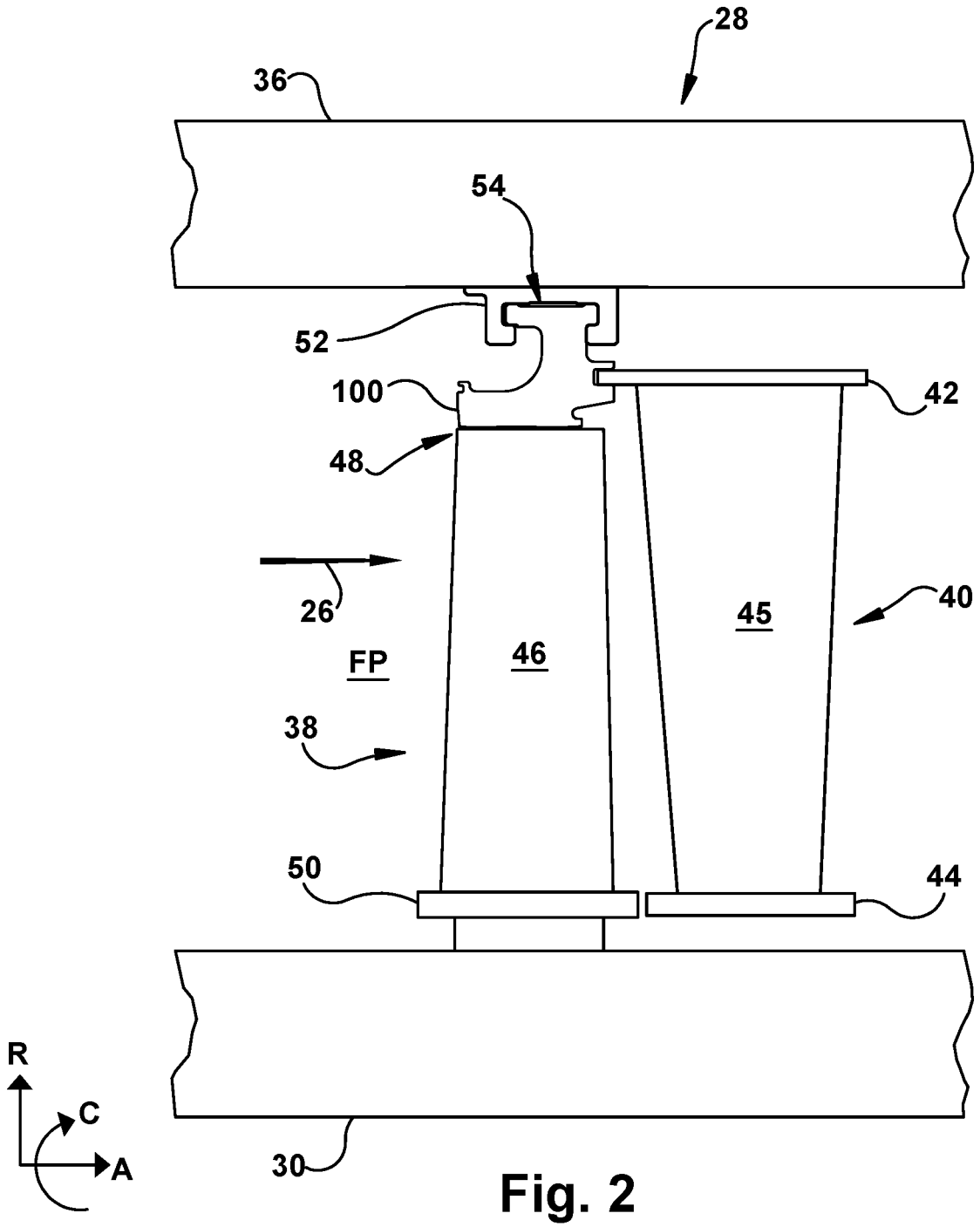
FIG. 2 shows a side view of a portion of a turbine of the gas turbine system of FIG. 1 including a turbine blade, a stator vane, a rotor, a turbine casing, and a turbine shroud, according to embodiments of the disclosure.

Turning to FIG. 2, a portion of turbine 28 is shown. Specifically, FIG. 2 shows a side view of a portion of turbine 28 including a stage of turbine blades 38 (one shown), and a stage of stator vanes 40 (one shown) positioned within casing 36 of turbine 28. As discussed herein, each stage (e.g., first stage, second stage (not shown), third stage (not shown)) of turbine blades 38 may include a plurality of turbine blades 38 that may be coupled to and positioned circumferentially around or about rotor 30 and may be driven by combustion gases 26 to rotate rotor 30. As show, the plurality of turbine blades 38 may also extend radially from rotor 30. Additionally, each stage (e.g., first stage, second stage (not shown), third stage (not shown)) of stator vanes 40 may include a plurality of stator vanes that may be coupled to and/or positioned circumferentially about casing 36 of turbine 28. In the non-limiting example shown in FIG. 2, stator vanes 40 may include a plurality of hot gas path (HGP) components including and/or be formed as an outer platform 42, and an inner platform 44 positioned opposite the outer platform 42. Stator vanes 40 of turbine 28 may also include an airfoil 45 positioned between outer platform 42 and inner platform 44. Outer platform 42 and inner platform 44 of stator vanes 40 may define a flow path (FP) for the combustion gases 26 flowing over stator vanes 40. As discussed herein, stator vanes 40 may be coupled to adjacent and/or surrounding turbine shrouds of turbine 28.

Each turbine blade 38 of turbine 28 may include an airfoil 46 extending radially from rotor 30 and positioned within the flow path (FP) of combustion gases 26 flowing through turbine 28. Each airfoil 46 may include tip portion 48 positioned radially opposite rotor 30. Turbine blade 38 may also include a platform 50 positioned opposite tip portion 48 of airfoil 46. In a non-limiting example, platform 50 may partially define a flow path for combustion gases 26 for turbine blades 38. Turbine blades 38 and stator vanes 40 may also be positioned axially adjacent to one another within casing 36. In the non-limiting example shown in FIG. 2, stator vanes 40 may be positioned axially adjacent and downstream of turbine blades 38. Not all turbine blades 38, stator vanes 40 and/or all of rotor 30 of turbine 28 are shown for clarity. Additionally, although only a portion of a single stage of turbine blades 38 and stator vanes 40 of turbine 28 are shown in FIG. 2, turbine 28 may include a plurality of stages of turbine blades and stator vanes, positioned axially throughout casing 36 of turbine 28.

Turbine 28 of gas turbine system 10 (see, FIG. 1) may also include a plurality of turbine shrouds 100 included within turbine 28. Turbine 28 may include a stage of turbine shrouds 100 (one shown). Turbine shrouds 100 may correspond with the stage of turbine blades 38 and/or the stage of stator vanes 40. That is, and as discussed herein, the stage of turbine shrouds 100 may be positioned within turbine 28 adjacent the stage of turbine blades 38 and/or the stage of stator vanes 40 to interact with and provide a seal in and/or define the flow path (FP) of combustion gases 26 flowing through turbine 28. In the non-limiting example shown in FIG. 2, the stage of turbine shrouds 100 may be positioned radially adjacent and/or may substantially surround or encircle the stage of turbine blades 38. Turbine shrouds 100 may be positioned radially adjacent tip portion 48 of airfoil 46 for turbine blade 38. Additionally in the non-limiting example, turbine shrouds 100 may also be positioned axially adjacent and/or upstream of stator vanes 40 of turbine 28. As discussed herein (see, FIG. 16), turbine shrouds 100 may be positioned between two adjacent stages of stator vanes that may surround and/or be positioned on either axially side of a single stage of turbine blades.

The stage of turbine shrouds may include a plurality of turbine shrouds 100 that may be coupled directly to and/or positioned circumferentially about casing 36 of turbine 28. In the non-limiting example shown in FIG. 2, turbine shrouds 100 may be coupled directly to casing 36 via extension 52 extending radially inward (e.g., toward rotor 30) from casing 36 of turbine 28. As discussed herein, extension 52 may include an opening 54 that may be configured to be coupled to and/or receive fasteners or hooks (see, FIG. 16) of turbine shrouds 100 to couple, position, and/or secure turbine shrouds 100 to casing 36 of turbine 28. In a non-limiting example, extension 52 may be coupled and/or fixed to casing 36 of turbine 28. More specifically, extension 52 may be circumferentially disposed around casing 36, and may be positioned radially adjacent turbine blades 38. In another non-limiting example, extension 52 may be formed integral with casing 36 for coupling, positioning, and/or securing turbine shrouds 100 directly to casing 36. Similar to turbine blades 38 and/or stator vanes 40, although only a portion of the stage of turbine shrouds 100 of turbine 28 is shown in FIG. 2, turbine 28 may include a plurality of stages of turbine shrouds 100, positioned axially throughout casing 36 of turbine 28 and coupled to casing 26 using extension 52.

Figure 3:
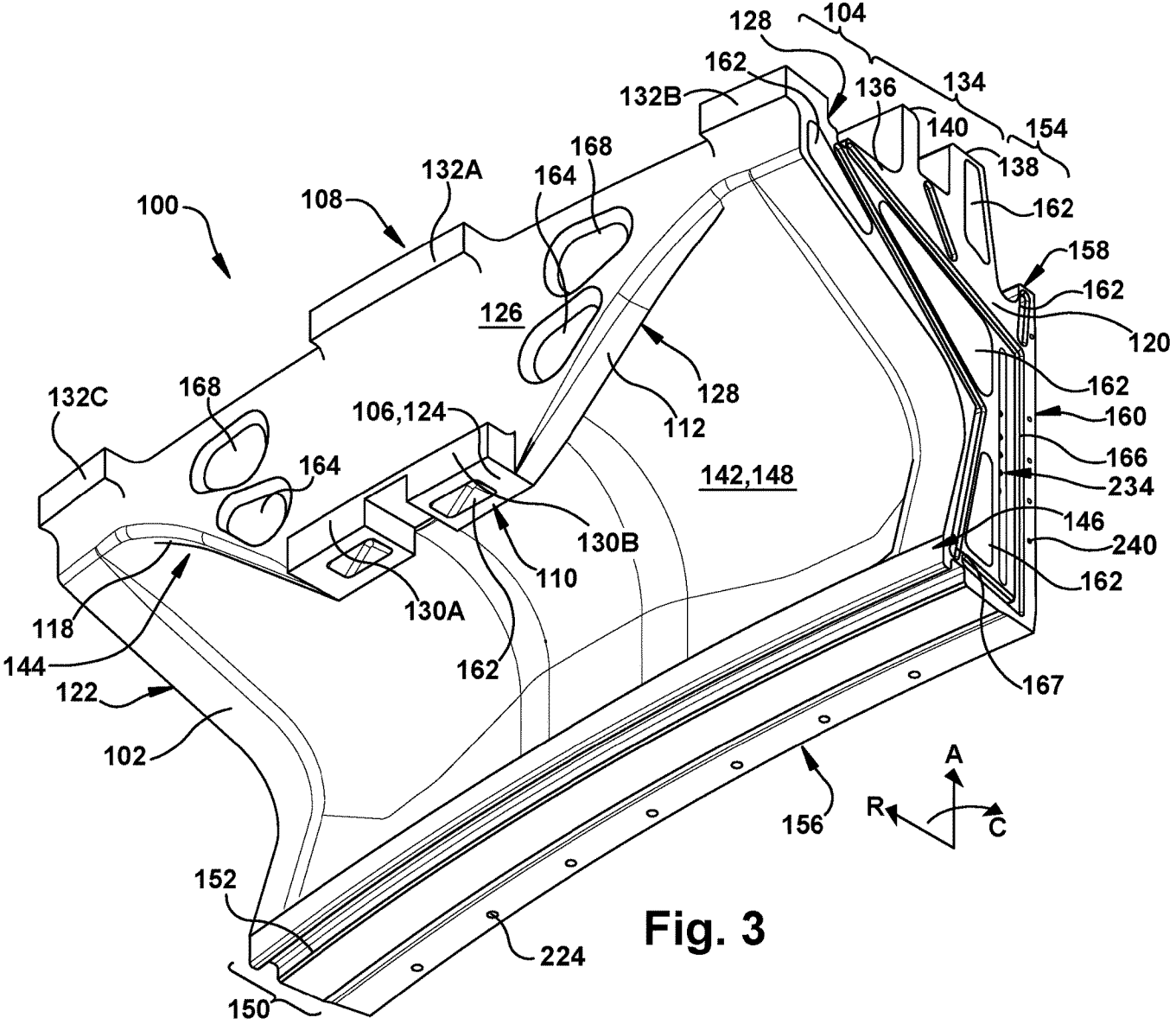
FIG. 3 shows perspective view of the turbine shroud of FIG. 2, according to embodiments of the disclosure.
Figure 4:
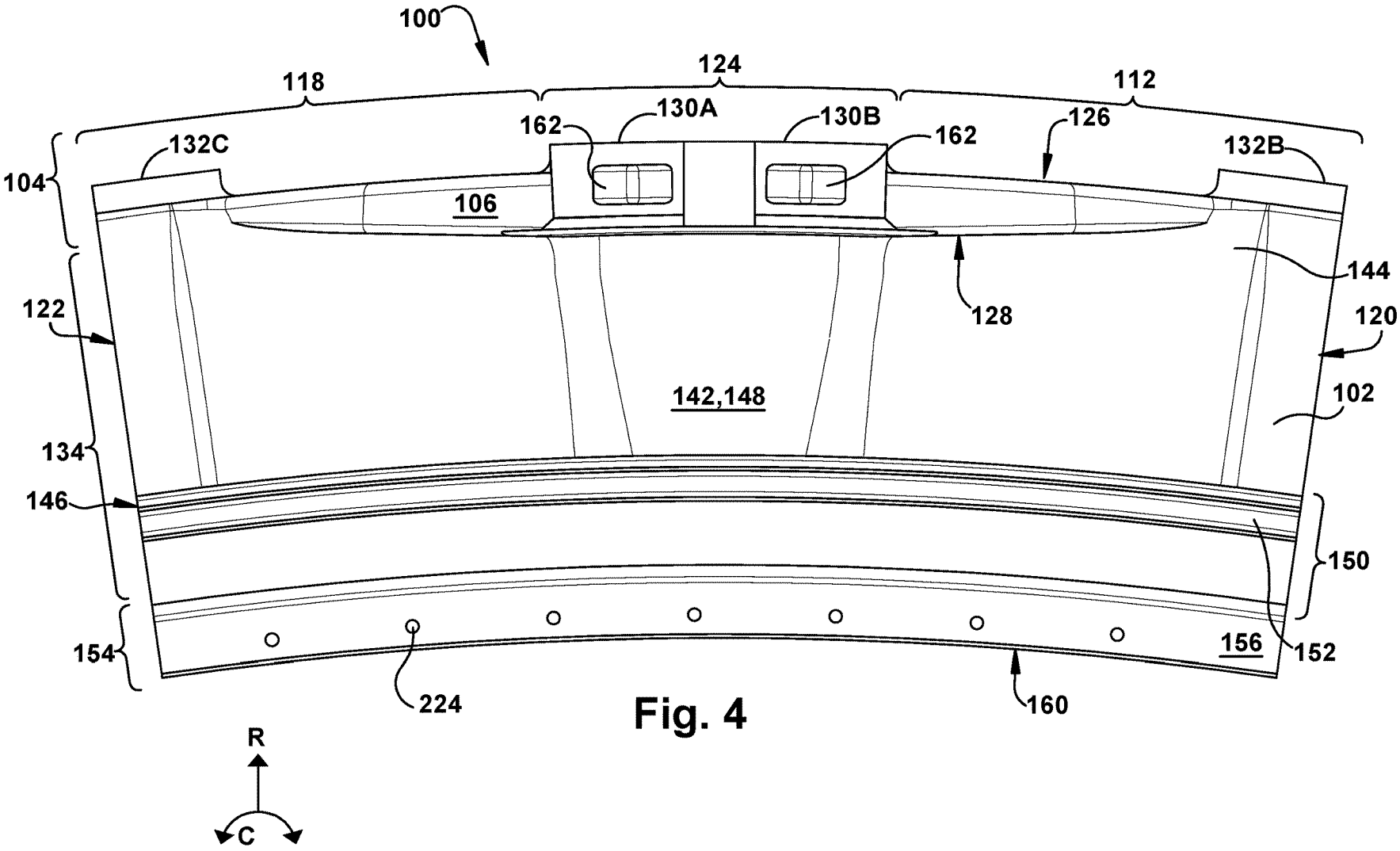
FIG. 4 shows a front view of the turbine shroud of FIG. 3, according to embodiments of the disclosure.
Figure 5:
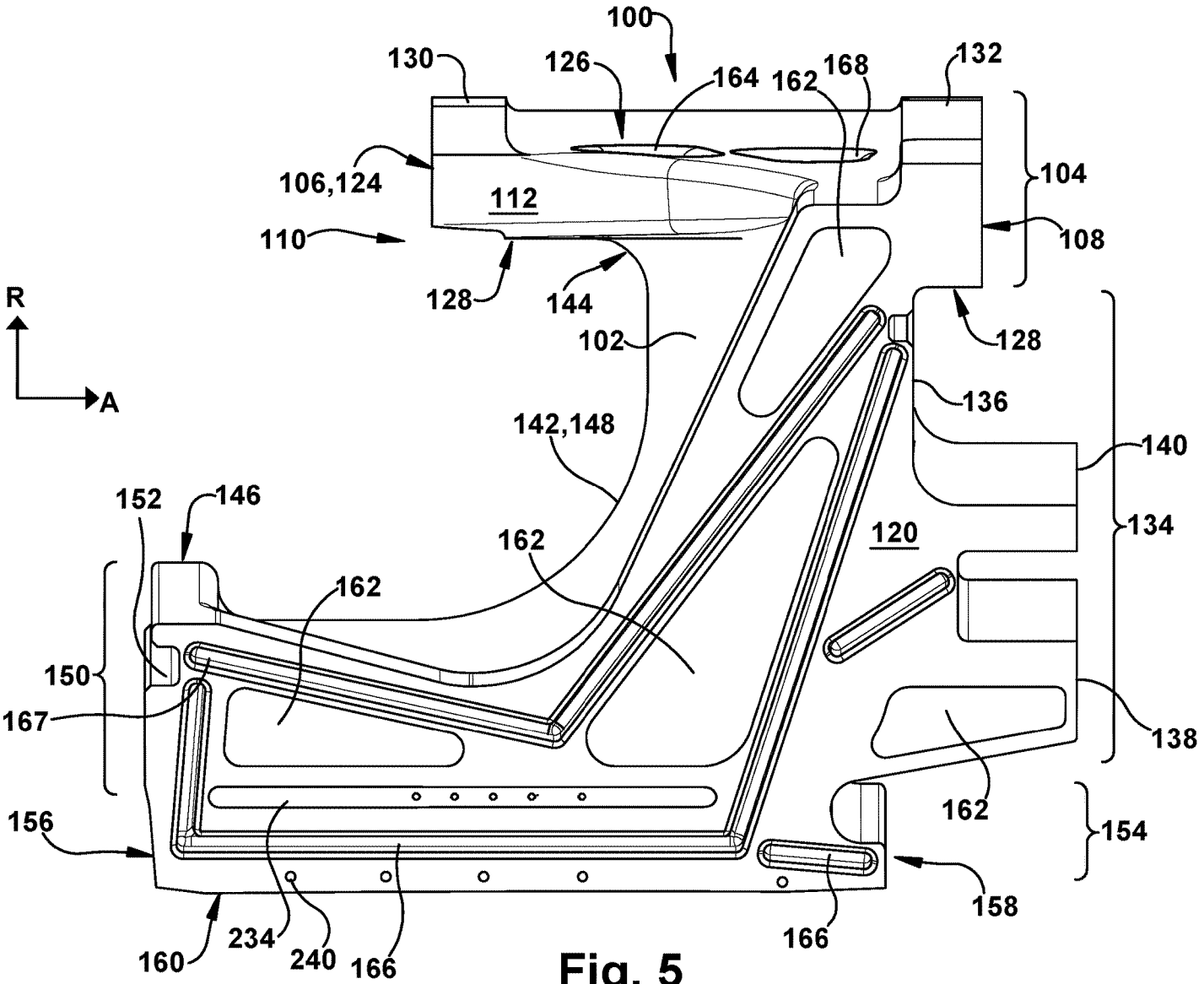
FIG. 5 shows a first side view of the turbine shroud of FIG. 3, according to embodiments of the disclosure.
Figure 6:
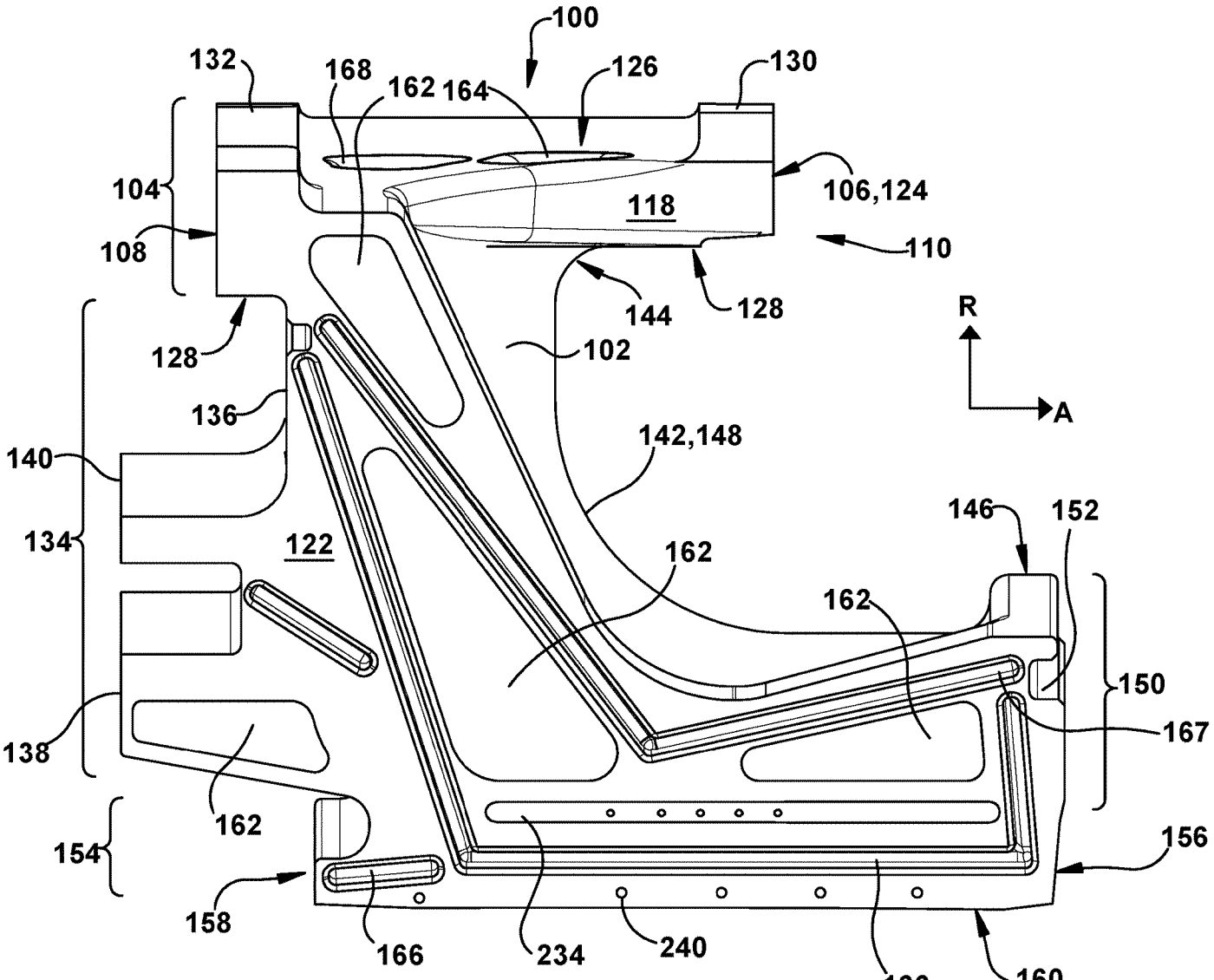
FIG. 6 shows a second side view of the turbine shroud of FIG. 3, according to embodiments of the disclosure.
Figure 7:
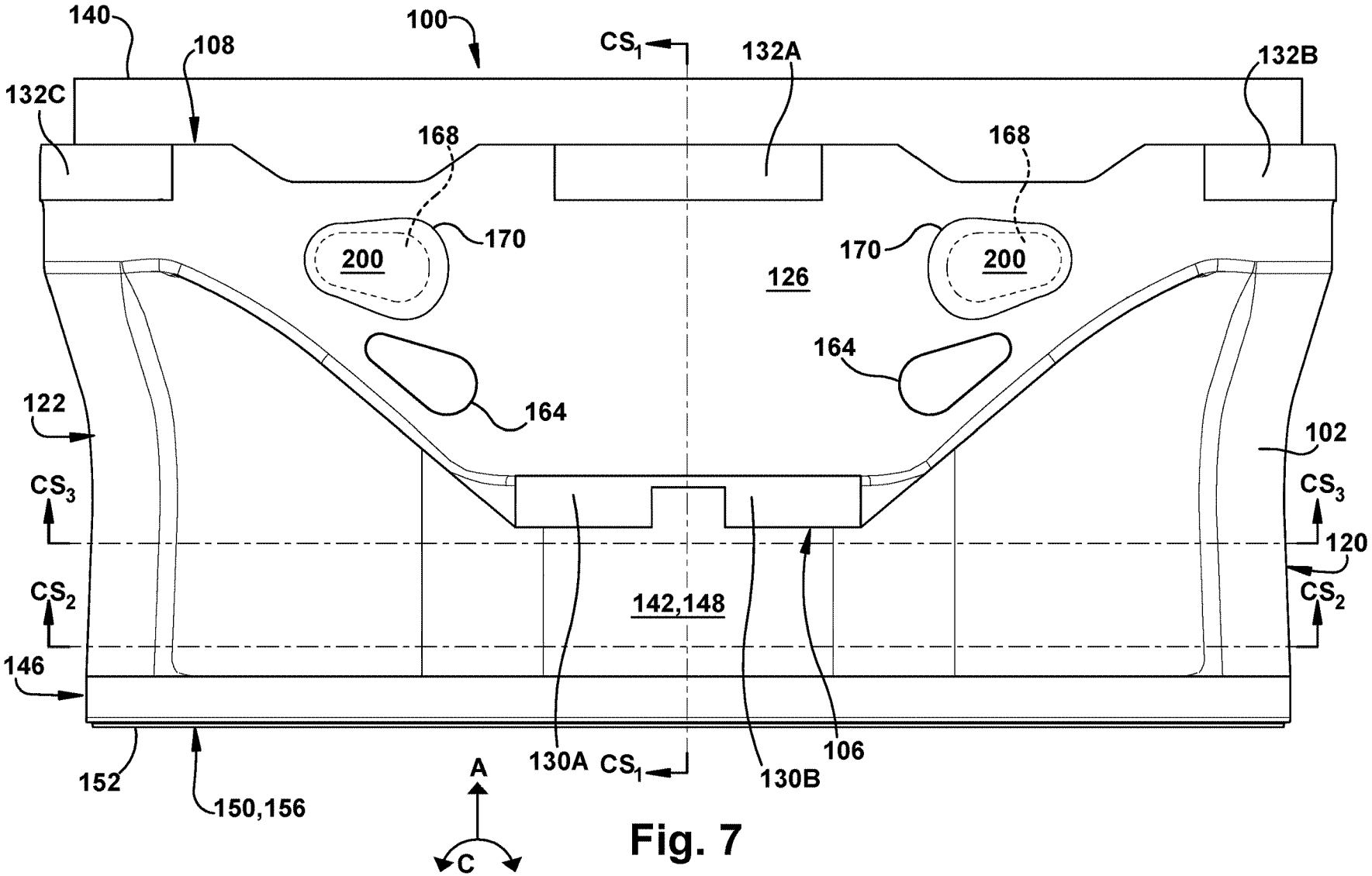
FIG. 7 shows a top view of the turbine shroud of FIG. 3, according to embodiments of the disclosure.

FIGS. 3-7 show various views of turbine shroud 100 of turbine 28 for gas turbine system 10 of FIG. 1. Specifically, FIG. 3 shows an isometric view of turbine shroud 100, FIG. 4 shows a front view of turbine shroud 100, FIG. 5 shows a first side view of turbine shroud 100, FIG. 6 shows a second view of turbine shroud 100, and FIG. 7 shows a top view of turbine shroud 100.

The non-limiting example of turbine shroud 100, and its various components, may be addressed herein with reference to all of FIGS. 3-7 to ensure that each of the plurality of components are adequately and accurately described and shown. When applicable, specific figures of the collective FIGS. 3-7 may be referenced when discussing a component(s) or feature of turbine shroud 100. Additionally, several reference lines or directions shown in FIGS. 1 and 2 may be used regularly herein, with respect to FIGS. 3 and 7. For example in each of FIGS. 3-7, "A" may refer represent an axial orientation or axis, "R" may refer to a radial axis substantially perpendicular with axis A, and "C" may refer to a circumferential direction, movement, and/or position along a path centric about axis "A," as discussed herein.

Turbine shroud 100 may include a body 102. In the non-limiting example shown in FIGS. 3-7, turbine shroud 100 may include and/or be formed as a unitary body 102 such that turbine shroud 100 is a single, continuous, and/or non-disjointed component or part. In the non-limiting example shown in FIGS. 3-7, because turbine shroud 100 includes unitary body 102, turbine shroud 100 may not require the building, joining, coupling, and/or assembling of various parts to completely form turbine shroud 100, and/or may not require building, joining, coupling, and/or assembling of various parts before turbine shroud 100 can be installed and/or implemented within turbine system 10 (see, FIG. 1). Rather, once single, continuous, and/or non-disjointed unitary body 102 for turbine shroud 100 is built, as discussed herein, turbine shroud 100 may be immediately installed within turbine system 10.

In the non-limiting example, unitary body 102 of turbine shroud 100, and the various components and/or features of turbine shroud 100, may be formed using any suitable additive manufacturing process and/or method. For example, turbine shroud 100 including unitary body 102 may be formed by direct metal laser melting (DMLM) (also referred to as selective laser melting (SLM)), direct metal laser sintering (DMLS), electronic beam melting (EBM), stereolithography (SLA), binder jetting, or any other suitable additive manufacturing process. As such, unitary body 102 of turbine shroud 100, and the various components and/or features integrally formed on and/or in unitary body 102 of turbine shroud 100, may be formed during a single, additive manufacturing process and/or method. Additionally, unitary body 102 of turbine shroud 100 may be formed from any material that may be utilized by additive manufacturing process(es) to form turbine shroud 100, and/or capable of withstanding the operational characteristics (e.g., exposure temperature, exposure pressure, and the like) experienced by turbine shroud 100 within gas turbine system 10 during operation.

As a result of being formed from unitary body 102, turbine shroud 100 may include various integrally formed portions that each may include different features, components, and/or segments that may provide a seal in and/or define the flow path (FP) of combustion gases 26 flowing through turbine 28 (see, FIG. 2). That is, and because turbine shroud 100 includes unitary body 102 formed using any suitable (single) additive manufacturing process and/or method, the features, components, and/or segments of turbine shroud 100 may be formed integrally with unitary body 102. The terms "integral features" or "integrally formed features" may refer to features formed on or in unitary body 102 during the (single) additive manufacturing process, features formed from the same material as unitary body 102, and/or features formed on or in unitary body 102 such that the features are not fabricated using distinct process(es) and/or raw material components that are separately and subsequently built, joined, coupled, and/or assembled on or in unitary body 102 of turbine shroud 100.

For example, turbine shroud 100 may include a support portion 104. As discussed herein, support portion 104, and features formed thereon, may be coupled directly to and/or aid in the coupling of turbine shroud 100 to turbine casing 36 and/or extension 52 (see, FIG. 16). Support portion 104 of unitary body 102 may include a forward end 106, and an aft end 108 positioned the forward end 106. Forward end 106 may be positioned axially upstream of aft end 108.

In the non-limiting example shown in FIGS. 3, 4, and 7 forward end 106 may include a protruding and/or converging shape, orientation, and/or configuration 110 (hereafter, "configuration 110"). That is, and as shown in the non-limiting example, forward end 106 of support portion 104 may be formed to have and/or include configuration 110 that may include opposing angular and/or curved walls 112, 118 that extend axially from opposing sides or slash faces 120, 122 of unitary body 102 and converge on a central wall 124. Central wall 124 of forward end 106 may be positioned and/or formed upstream of walls 112, 118, and/or may be positioned axially forward of the remaining portions of support portion 104 of unitary body 102. That is, central wall 124 may be the axially-forward most portion of forward end 106 of support portion 104 for unitary body 102.

Additionally, support portion 104 may also include a first surface 126, and a second surface 128. First surface 126 and second surface 128 may extend (axially) between forward end 106 and aft end 108. Additionally, first surface 126 and second surface 128 may be formed or extend substantially perpendicular to forward end 106 and/or aft end 108 of support portion 104. As shown in the non-limiting example, second surface 128 of support portion 104 may be positioned and/or formed (radially) opposite first surface 110.

Figure 16:
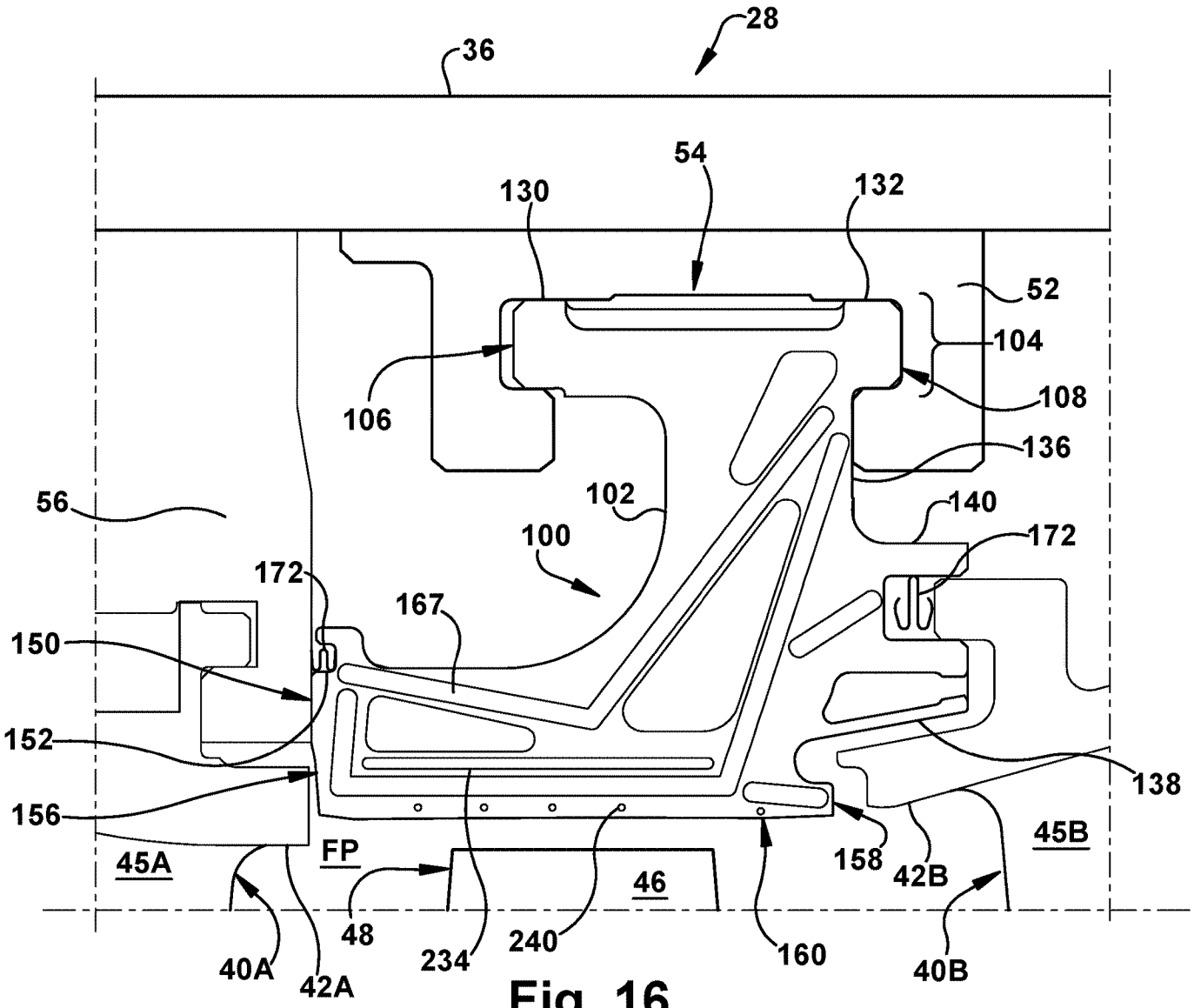
FIG. 16 shows an enlarged side view of a portion of the gas turbine system of FIG. 2 including the turbine shroud of FIG. 3, according to embodiments of the disclosure.

Unitary body 102 for turbine shroud 100 may also include a plurality of hooks for coupling turbine shroud 100 to turbine casing 36 and/or extension 52 (see, FIG. 16). As shown in FIGS. 3-7, unitary body 102 may include at least one forward hook 130, and at least one aft hook 132. Forward hook(s) 130 and aft hook(s) 132 may be formed integral with support portion 104 of unitary body 102. More specifically, forward hook(s) 130 may be formed integral with forward end 106 of support portion 104, and aft hook(s) 132 may be formed integral with aft end 108 of support portion 104, (axially) opposite forward hook(s) 130. Additionally as shown in FIGS. 3-6, forward hook(s) 130 and aft hook(s) 132 may also extend (radially) adjacent first surface 126 of support portion 104. That is, forward hook(s) 130 and aft hook(s) 132 formed integral with forward end 106 and aft end 108, respectively, may extend radially adjacent, and more specifically radially outward, first surface 126 of support portion 104.

In the non-limiting example shown in FIGS. 3-7, unitary body 102 of turbine shroud 100 may include two forward hooks 130A, 130B. Two forward hooks 130A, 130B may be formed integral with and centrally positioned on forward end 106 of support portion 104, between first slash face 120 and second slash face 122 of unitary body 102. More specifically, two forward hooks 130A, 130B may be formed integrally with central wall 124 of forward end 106 of support portion 104. Additionally, and as shown in the non-limiting example, two forward hooks 130A, 130B may be formed (circumferentially) between walls 112, 118 of forward end 106 of support portion 104.

Additionally in the non-limiting example shown in FIGS. 3-7, unitary body 102 of turbine shroud 100 may include three distinct aft hooks 132A, 132B, 132C. Three aft hooks 132A, 132B, 132C may be formed integral with aft end 108 of support portion 104, between first slash face 120 and second slash face 122 of unitary body 102. For example, a first aft hook 132A may be formed integral with and centrally position on aft end 108 of support portion 104, between slash face 120 and second slash face 122 of unitary body 102. In the non-limiting example, first aft hook 132A may be formed on aft end 108 of support portion 104 axially opposite and/or in axial alignment with two forward hooks 130A, 130B formed on first end 106 of support portion 104. Additionally, a second aft hook 132B may be formed integral with aft end 108 of support portion 104, directly adjacent first slash face 120 of unitary body 102. A third aft hook 132C may be formed integral with aft end 108 of support portion 104, directly adjacent second slash face 122 of unitary body 102. Third aft hook 132C may be formed on support portion 104 circumferentially opposite second aft hook 132B.

It is understood that the size, shape, and/or number of hooks 130, 132 included in turbine shroud 100, as shown in FIGS. 3-7, is merely illustrative. As such, turbine shroud 100 may include more or less, larger or smaller, and/or distinctly shaped hooks 130, 132 formed therein. The size, shapes, and/or number of hooks 130, 132 included in turbine shroud 100 may depend at least in part on various parameters (e.g., exposure temperature, exposure pressure, position within turbine casing 36, associated turbine blade 38 stage, size or shape of extension 52, size or shape of opening 54, and the like) of gas turbine system 10 during operation. Additionally, or alternatively, the size, shapes, and/or number of hooks 130, 132 included in turbine shroud 100 may be dependent, at least in part on the characteristics (e.g., size or shape of support portion 104) of turbine shroud 100.

In the non-limiting example shown in FIGS. 3-7, unitary body 102 of turbine shroud 100 may also include intermediate portion 134. Intermediate portion 134 may be formed integral with and extending from support portion 104. More specifically, intermediate portion 134 of unitary body 102 may be formed integral with and may extend radially away from second surface 128 of support portion 104. In the non-limiting example, intermediate portion 134 of turbine shroud 100 may be positioned radially between support portion 104 of unitary body 102 and turbine blade 38 of turbine 28 (see, FIG. 16).

Intermediate portion 134 may include various features and/or segments of unitary body 102 for turbine shroud 100. The various features and/or segments discussed herein may extend and/or be formed between opposing slash faces 120, 122 of unitary body 102. For example, intermediate portion 134 may include an aft segment 136 extending perpendicularly and/or radially away from second surface 128 of support portion 104. Additionally as shown in FIGS. 3, 5, and 6, aft segment 136 of intermediate portion 134 may be extending from second surface 128 substantially adjacent aft end 108 of support portion 104 and/or aft hook(s) 132 of unitary body 102. In the non-limiting example, at least a portion of aft segment 136 of intermediate portion 134 may be positioned axially upstream of aft end 108 of support portion 104 and/or aft hook(s) 132 of unitary body 102.

Aft segment 136 of intermediate portion 134 may include additional features and/or components as well. For example, and as shown in FIGS. 3, and 5-7, unitary body 102 may include at least one flange 138, 140 formed integral with and extending from aft segment 136 of intermediate portion 134. In the non-limiting example, flange(s) 138, 140 may extend across aft segment 136 of intermediate portion 134, between opposing slash faces 120, 122 of unitary body 102. Additionally as shown in FIGS. 5 and 6, flange(s) 138, 140 formed integral with aft segment 136 may extend axially beyond and/or at least partially downstream of aft end 108 of support portion 104 and/or aft hook(s) 132 of unitary body 102. As discussed herein, flange(s) 138, 140 may be used to form a seal within turbine 28, define the flow path (FP) of combustion gases 26 flowing through turbine 28, and/or may secure stator vanes 40 within casing 36 of turbine 28 (see, FIG. 16).

Intermediate portion 134 may also include a non-linear segment 142 extending away from second surface 128 of support portion 104. As shown in FIGS. 3, 5, and 6, non-linear segment 142 of intermediate portion 134 may extend substantially radially from second surface 128, between forward end 106 and aft end 108 of support portion 104 of unitary body 102, and axially adjacent aft segment 136. Non-linear segment 142 of intermediate portion 134 may include a first end 144 formed integral with second surface 128 of support portion 104 between forward end 106 and aft end 108. Additionally, non-linear segment 142 may include a second end 146 positioned opposite first end 144. Second end 146 of non-linear segment 142 may positioned radially adjacent and axially upstream of first end 144. Additionally, second end 146 of non-linear segment 142 of intermediate portion 134 may also be positioned axially upstream of forward end 106 of support portion 104, as well as forward hook(s) 130 formed integral with forward end 106 of support portion 104. A curved section 148 may extend between first end 144 and second end 146 of non-linear segment 142. That is, non-linear segment 142 may also include curved section 148 extending between first end 144 and second end 146. In the non-limiting example shown in FIGS. 3, 5, and 6, curved section 148 extending between first end 144 and second end 146 may include a substantially concave-shape or configuration, such that a side view of intermediate portion 134 and/or unitary body 102 of turbine shroud 100 may appear to be a backwards "C." As a result of extending between first end 144 and second end 146, at least a portion of curved section 148 may also be positioned or extend axially upstream of forward end 106 of support portion 104. Additionally, at least a portion of curved section 148 may be positioned or extend axially upstream of forward hook(s) 130 formed integral with forward end 106 of support portion 104.

In the non-limiting example shown in FIGS. 3-7, intermediate portion 134 of unitary body 102 may also include a forward segment 150. Forward segment 150 of intermediate portion 134 may be formed integral with second end 146 of non-linear segment 142. Additionally, forward segment 150 may be formed substantially adjacent to, perpendicular to, and/or axially upstream of second end 146 of non-linear segment 142. As shown, forward segment 150 of intermediate portion 134 may also be positioned axially upstream of forward end 106 of support portion 104, as well as forward hook(s) 130 formed integral with forward end 106 of support portion 104. Forward segment 150 of intermediate portion 134 may include a channel or shelf 152 (hereafter, "shelf 152") extending at least partially between first slash face 120 and second slash face 122 of unitary body 102. Shelf 152 may be formed and/or extend axially into forward segment 150. As discussed herein, forward segment 150 and shelf 152 may be used to form a seal within turbine 28, define the flow path (FP) of combustion gases 26 flowing through turbine 28, and/or secure stator vanes 40 within casing 36 of turbine 28 (see, FIG. 16).

Unitary body 102 of turbine shroud 100 may also include a seal portion 154. Seal portion 154 may be formed integral with intermediate portion 134. That is, seal portion 154 of unitary body 102 may be formed integral with intermediate portion 134 and may be positioned radially opposite support portion 104. In the non-limiting example, and as discussed herein seal portion 154 of turbine shroud 100 may be positioned radially between intermediate portion 134 of unitary body 102 and turbine blade 38 of turbine 28, and may at least partially define a flow path (FP) for combustion gases 26 flowing through turbine 28 (see, FIG. 16).

In the non-limiting example, seal portion 154 may include a forward end 156. Forward end 156 of seal portion 154 may be formed and/or extend between opposing slash faces 120, 122 of unitary body 102. Additionally, forward end 156 may be formed integral with, radially adjacent, and/or radially aligned with forward segment 150 of intermediate portion 134. As a result, forward end 156 may be formed substantially adjacent to, perpendicular to, and/or axially upstream of second end 146 of non-linear segment 142. Forward end 156 of seal portion 154 may also be positioned axially upstream of forward end 106 of support portion 104, as well as forward hook(s) 130 formed integral with forward end 106 of support portion 104. Because unitary body 102 includes support 104 and intermediate portion 134 having non-linear segment 142, as discussed herein, forward end 156 of seal portion 154 may be positioned axially upstream of support portion 104 in a substantially cantilever manner or fashion without being directly coupled or connected to, and/or being formed integral with support portion 104. As a result, forward end 156, as well as other portions of seal portion 154, may thermally expand during operation of turbine 28 without causing undesirable mechanical stress or strain on other portions (e.g., support portion 104, intermediate portion 134) of turbine shroud 100.

Seal portion 154 may also include an aft end 158 positioned and/or formed opposite of forward end 156. Aft end 158 may also be positioned downstream of forward end 156, such that combustion gases 26 flowing through the flow path (FP) defined within turbine 28 may flow adjacent forward end 156 before flowing by adjacent aft end 158 of seal portion 154 for unitary body 102 of turbine shroud 100. Aft end 158 of seal portion 154 may be formed integral with, radially adjacent, and/or radially aligned with aft segment 136 of intermediate portion 134.

In the non-limiting example shown in FIGS. 3-7, seal portion 154 may also include a hot gas path (HGP) surface 160. HGP surface 160 of seal portion 154 may be integrally formed and/or extend axially between forward end 156 and aft end 158. Additionally, HGP surface 160 of seal portion 154 may be integrally formed and/or extend circumferentially between opposing slash faces 120, 122 of unitary body 102. HGP surface 160 may also be formed radially opposite first surface 126 of support portion 104 of unitary body 102. As discussed herein, HGP surface 160 may be positioned adjacent a hot gas flow path (FP) of combustion gases 26 of turbine 28. That is, and as discussed herein with respect to FIG. 16, HGP surface 160 may be positioned, formed, face, and/or directly exposed to the hot gas flow path (FP) of combustion gases 26 flowing through turbine casing 36 of turbine 28 for gas turbine system 10 (see, FIG. 2). Additionally when included in turbine casing 36, HGP surface 160 of unitary body 102 for turbine shroud 100 may be positioned radially adjacent tip portion 48 of airfoil 46 (see, FIG. 16).

As discussed herein, unitary body 102 of turbine shroud 100 may include first slash face 120 and second slash face 122. As shown in the non-limiting example of FIGS. 5 and 6, opposing slash faces 120, 122 of unitary body 102 may form side walls extending radially over unitary body 102 of turbine shroud 100. More specifically, first slash face 120 may extend adjacent to and radially between first surface 126 of support portion 104 and HGP surface 160 of seal portion 154, and second slash face 122 may extend adjacent to and radially between first surface 126 of support portion 104 and HGP surface 160 of seal portion 154, circumferentially opposite first slash face 120. As such, slash faces 120, 122 may extend over the various portions forming unitary body 102. Slash faces 120, 122 specifically may extend over support portion 104, intermediate portion 134, and/or seal portion 154, to form circumferential boundaries, side walls and/or side surfaces for unitary body 102.

Turbine shroud 100 may also include a plurality of features to reduce overall weight and/or material requirement for forming turbine shroud 100 from unitary body 102. For example, at least one cavity 162 may be formed on first slash face 120 and/or second slash face 122 of unitary body 102. More specifically, and as shown in FIGS. 3, 5, and 6, at least one cavity 162 may be formed on and/or may extend over at least a portion of slash faces 120, 122, between first surface 126 of support portion 104 and HGP surface 160 of seal portion 154. In the non-limiting example, cavities 162 may be formed on and/or extend over slash faces 120, 122 in circumferential and/or radial alignment with at least a portion of support portion 104, intermediate portion 134, and seal portion 154. Additionally, and as shown, cavities 162 may be formed on and/or extend over additional features of unitary body 102, for instance flange 138 formed integral with aft segment 136 of intermediate portion 134. The at least one cavity 162 formed on slash faces 120, 122 may not extend through any portion of unitary body 102 for turbine shroud 100, and/or may not be in fluid communication with any internal features (e.g., cooling circuits) formed in turbine shroud 100. Rather, the at least one cavity 162 may be formed as hollows, voids, depression, dimples, and/or indentions in slash faces 120, 122. The inclusion of cavity 162 in slash faces 120, 122 may reduce the weight the of turbine shroud 100, add flexibility to turbine shroud 100, and/or reduce the material (and in turn manufacturing cost) required to build or additively manufacture turbine shroud 100.

It is understood that the size, shape, and/or number of cavities 162 included in turbine shroud 100, as shown in FIGS. 3, 5, and 6, are merely illustrative. As such, turbine shroud 100 may include more or fewer, larger or smaller, and/or distinctly shaped cavities 162 formed therein. The size, shapes, and/or number of cavities 162 included in turbine shroud 100 may depend at least in part on various parameters (e.g., exposure temperature, exposure pressure, position within turbine casing 36, associated turbine blade 38 stage, size or shape of extension 52, size or shape of opening 54, and the like) of gas turbine system 10 during operation. Additionally, or alternatively, the size, shapes, and/or number of cavities 162 included in turbine shroud 100 may depend, at least in part on the characteristics (e.g., size or shape of unitary body 102) of turbine shroud 100. Additionally, although shown as being formed on slash faces 120, 122, it is understood that distinct portions of unitary body 102 for turbine shroud 100 may include cavities 162 formed thereon. For example, and as shown in FIG. 3, cavities 162 may be formed on and/or extend over a portion forward end 106 of support portion 104 and/or forward hooks 130A, 130B formed integral with forward end 106.

Additionally, turbine shroud 100 may also include at least one hole 164 formed therein to reduce overall weight and/or material requirement for forming turbine shroud 100 from unitary body 102. In the non-limiting example shown in FIGS. 3 and 7, a plurality of holes 164 may be formed through support portion 104 of unitary body 102. That is, unitary body 102 may include holes 164 formed through first surface 126 and second surface 128 of support portion 104. Holes 164 may be formed adjacent forward end 106 of support portion 104. Additionally, holes 164 may also be formed through support portion 104 adjacent and/or radially above curved section 148 of non-linear segment 142 for intermediate portion 134. Similar to cavities 162, holes 164 formed in unitary body 102 of turbine shroud 100 may reduce the weight the of turbine shroud 100, add flexibility to turbine shroud 100, and/or reduce the material (and in turn manufacturing cost) required to build or additively manufacture turbine shroud 100.

Unitary body 102 may also include seal slots 166, 167. Seal slots 166, 167 may be formed in on and/or in first slash face 120 and second slash face 122, respectively. As shown in FIGS. 5 and 6, each of first slash face 120 and second slash face 122 may include a plurality of seal slots 166, 167 formed on and/or extending over the respective face or surface. For example, each of first slash face 120 and second slash face 122 may include a hot gas path (HGP) seal slot 166, and a secondary seal slot 167. HGP seal slot 166 may be formed on opposing slash faces 120, 122 radially between secondary seal slot 167 and HGP surface 160 of seal portion 154. Each of the plurality of seal slots 166, 167 may receive a sealing component (not shown) to interact with a sealing component of a circumferentially adjacent turbine shroud 100 used within turbine 28 (see, FIG. 2). Sealing components positioned within seal slots 166, 167 of unitary body 102 for turbine shroud 100 may form a seal within turbine 28, define the flow path (FP) of combustion gases 26 flowing through turbine 28, and/or prevent leakage of combustion gases 26 into a cooling fluid discharge area for turbine shrouds 100. In the non-limiting example, HGP seal slot 166 may receive a sealing component that may define the flow path of combustion gases 26 flowing through turbine 28 and/or separate the combustion gases flow path from the cooling fluid discharge area. As such, HGP seal slot 166 may prevent leakage of combustion gases 26 into a cooling fluid discharge area for turbine shrouds 100, and vice versa.

In the non-limiting example shown in FIGS. 3 and 7, unitary body 102 for turbine shroud 100 may also include at least one inlet opening 168. Inlet opening(s) 168 may be formed in and/or through first surface 126 of support portion 104, between forward end 106 and aft end 108. Additionally, inlet opening(s) 168 may also be formed in first surface 126 and/or through support portion 104 axially downstream of non-linear segment 142 of intermediate portion 134. In a non-limiting example, inlet opening(s) 168 may be in fluid communication with a cooling circuit (not shown) formed through unitary body 102. More specifically, inlet opening(s) 168 formed in first surface 126 may extend through at least a portion of support portion 104, and may be in fluid communication with a cooling circuit formed through and/or included within support portion 104, intermediate portion 134, and/or seal portion 154 of unitary body 102.

Turning to FIG. 7, turbine shroud 100 may also include, for example, a meter plate 170 coupled to first surface 126 of support portion 104. Meter plate 170 may be affixed to first surface 126, over and/or at least partially covering inlet opening(s) 168 to regulate (e.g., amount, pressure) the cooling fluid that may flow through inlet opening(s) 168 to the cooling circuit (not shown) formed within turbine shroud 100. Meter plate 170 may be affixed and/or coupled to first surface 126 of support portion 104 using any suitable joining and/or coupling technique and/or process. In a non-limiting example where turbine shroud 100 includes meter plate 170, coupling meter plate 170 to first surface 126 to at least partially cover inlet opening 168 may be the only post-additive manufacturing process required to be performed on turbine shroud 100 before turbine shroud 100 is ready to be installed and/or used within turbine 28. As such, and as discussed herein, forming turbine shroud 100 to include unitary body 102, and the various features discussed herein, may reduce the cost, time, and/or process for building and installing turbine shroud 100 within turbine 28.

Figure 8:
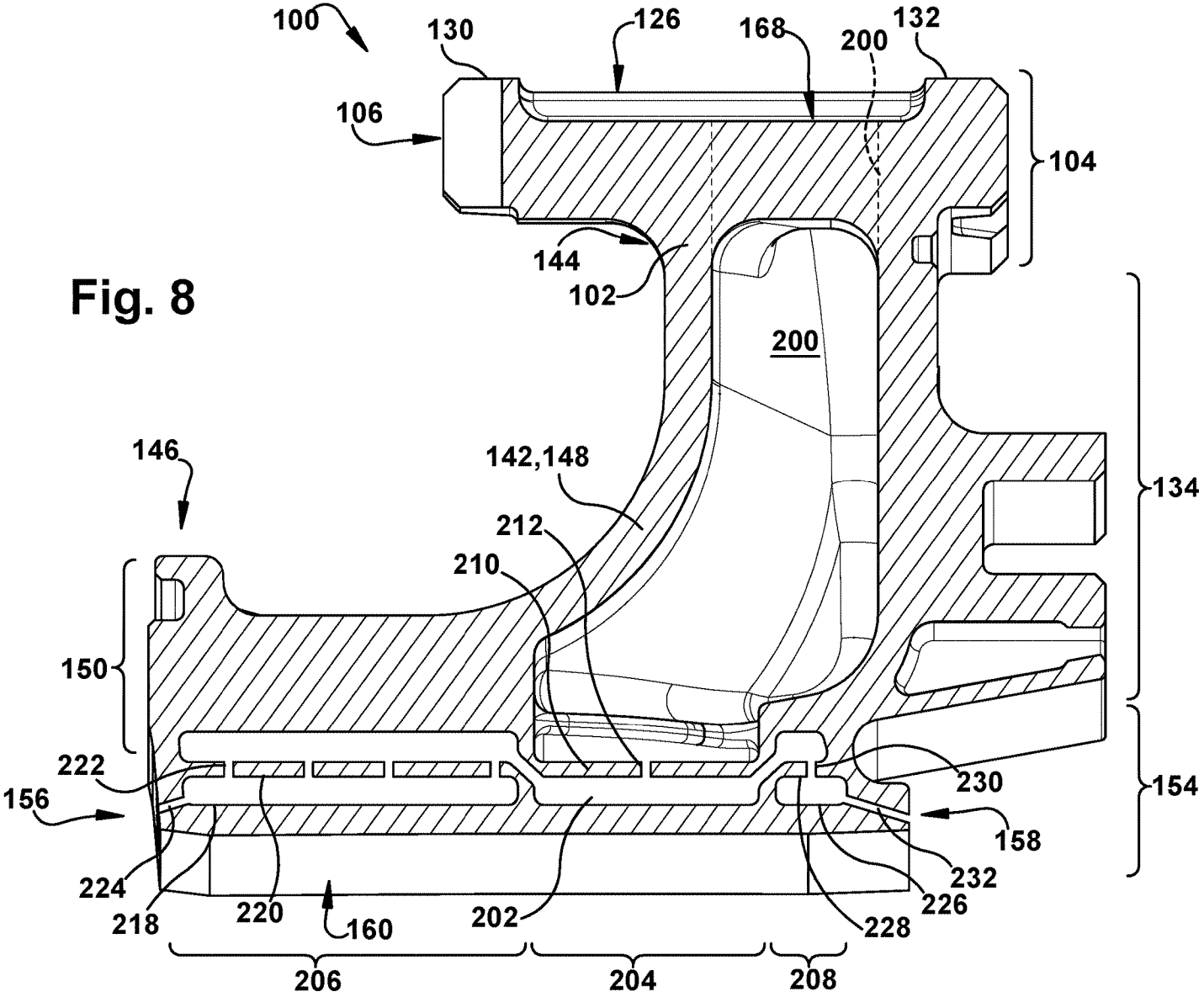
FIG. 8 shows a side cross-sectional view of the turbine shroud of FIG. 7 taken along line CS1-CS1, according to embodiments of the disclosure.
Figure 9:
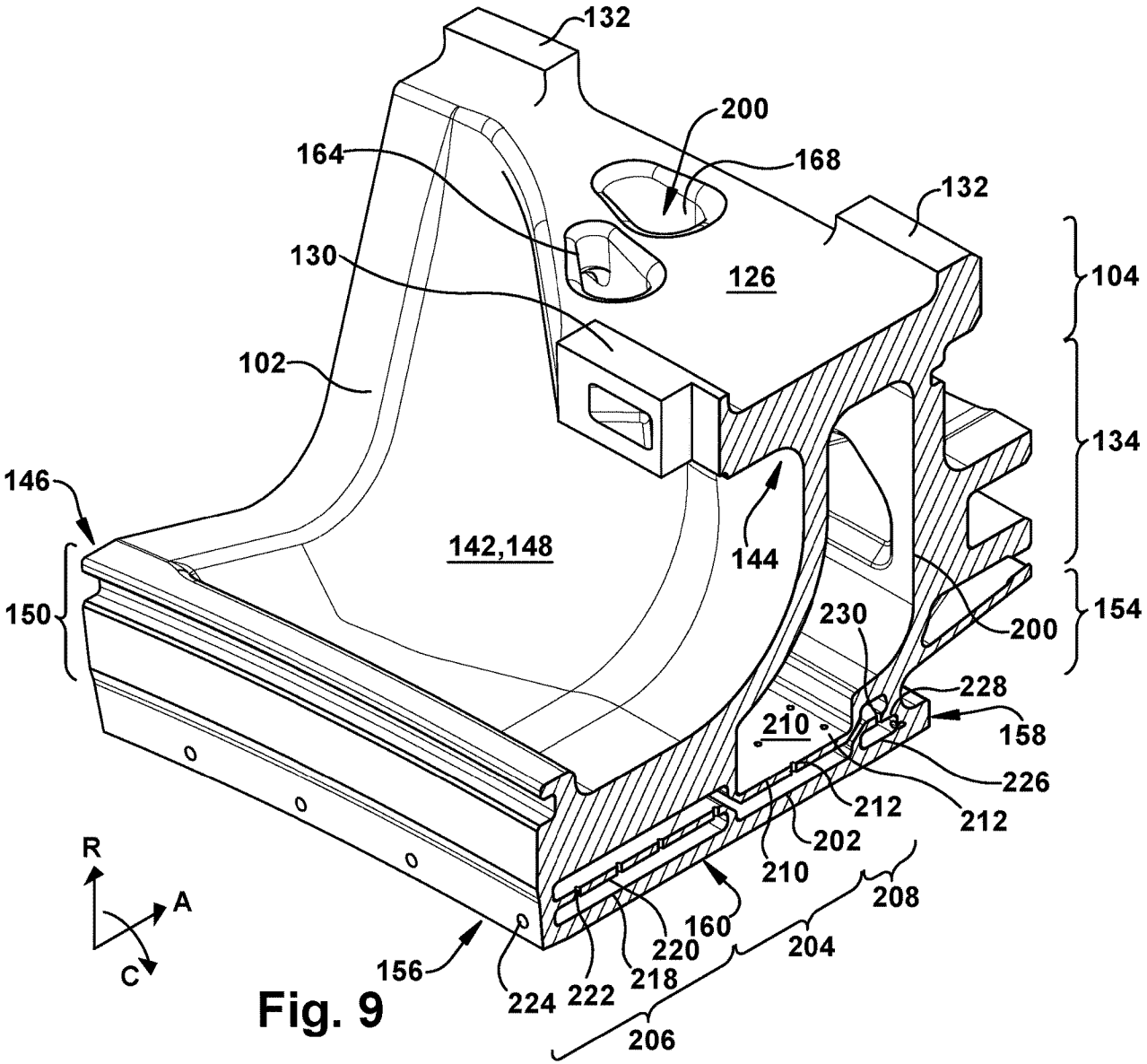
FIG. 9 shows a perspective view of the turbine shroud of FIG. 8, according to embodiments of the disclosure.
Figure 10:
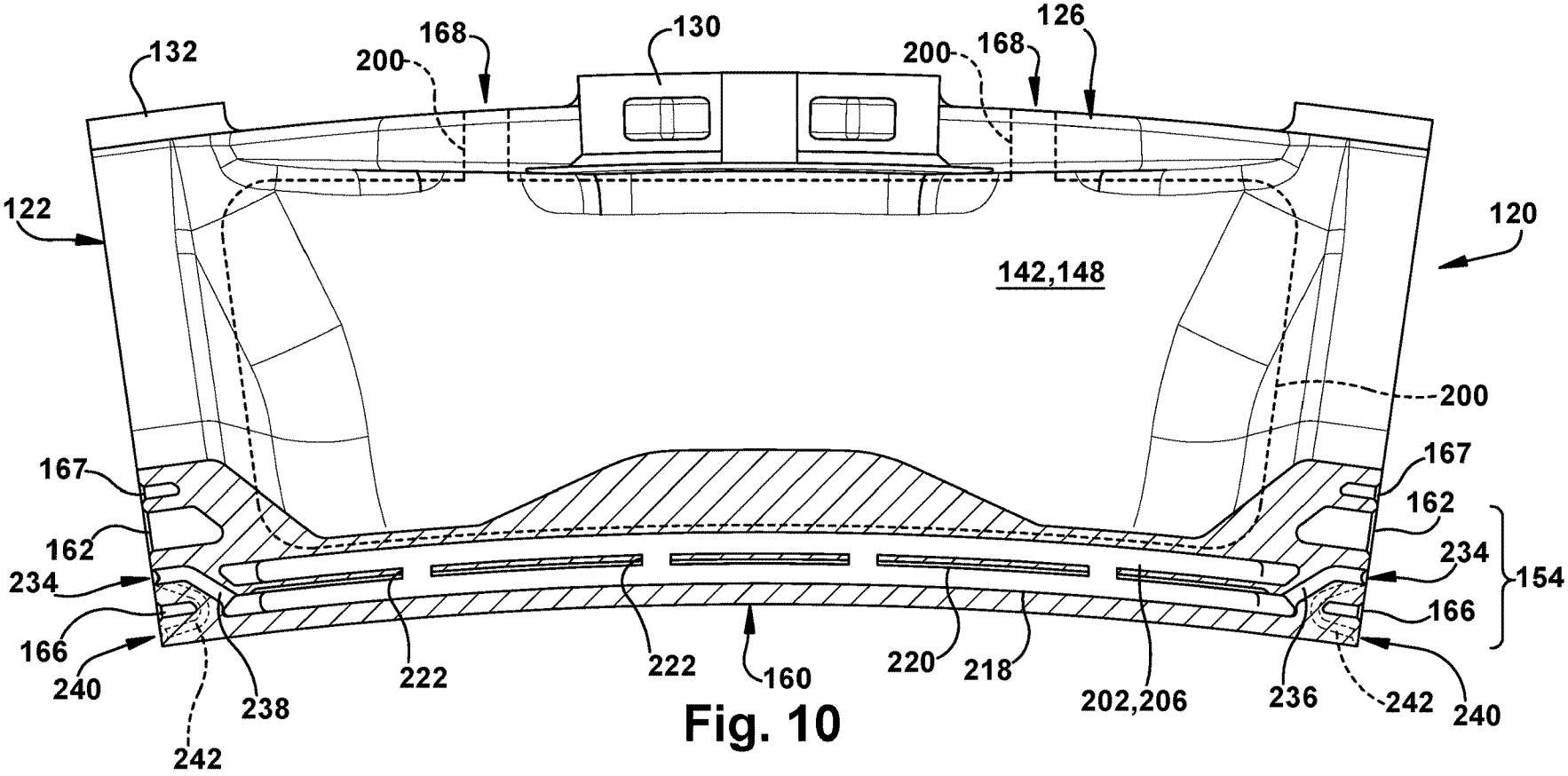
FIG. 10 shows a front cross-sectional view of the turbine shroud of FIG. 7 taken along line CS2-CS2, according to embodiments of the disclosure.
Figure 11:
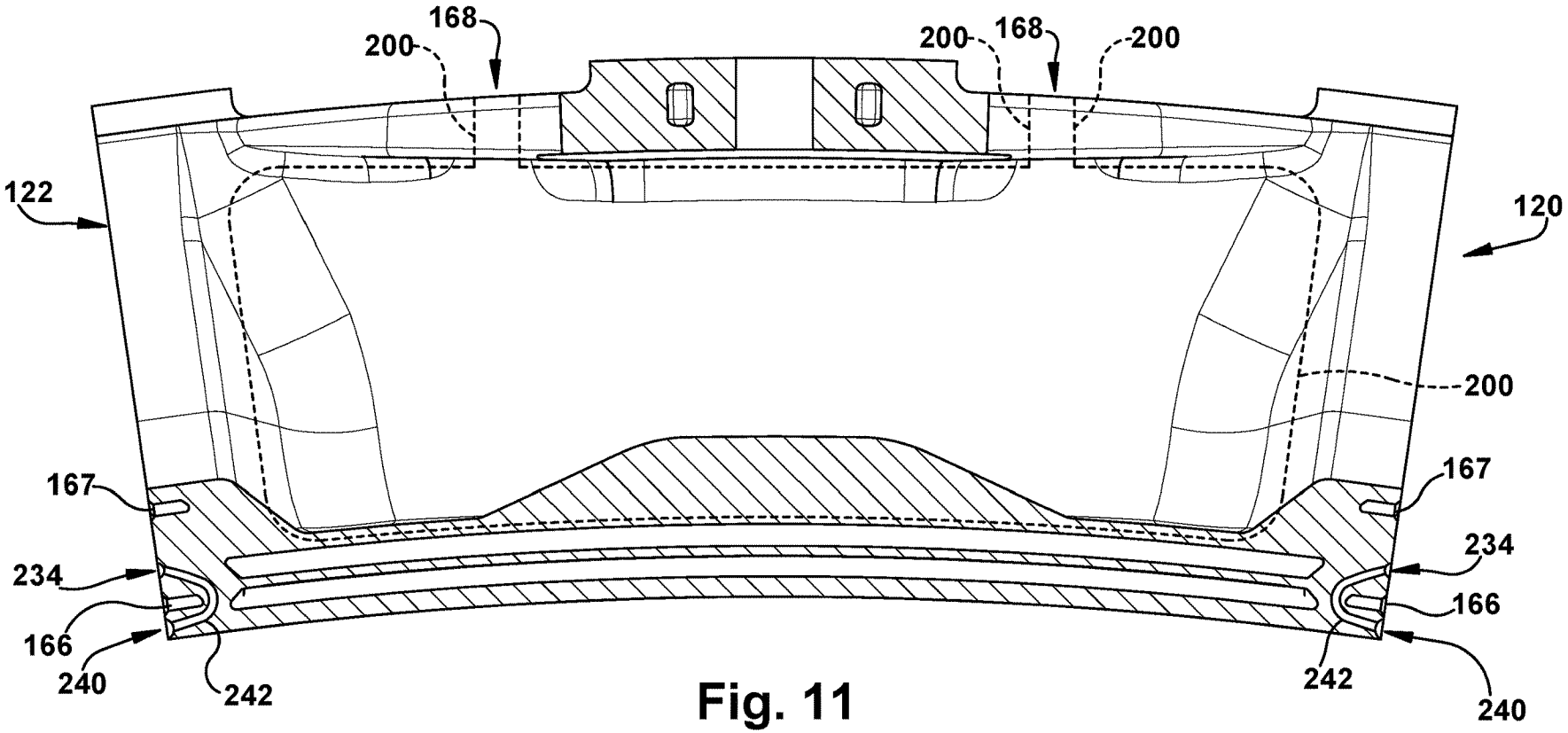
FIG. 11 shows a front cross-sectional view of the turbine shroud of FIG. 7 taken along line CS3-CS3, according to embodiments of the disclosure.

Turbine shroud 100 may also include plenum(s) and/or cooling passage(s) formed therein for cooling turbine shroud 100 during operation of turbine 28 of gas turbine system 10. Turning to FIGS. 8-11, with continued reference to FIGS. 3-7, the various plenum(s) and/or cooling passage(s) of turbine shroud 100 are described. FIG. 8 shows a side cross-sectional view of turbine shroud 100 taken along line CS1-CS1 in FIG. 7, FIG. 9 shows a perspective cross-sectional view turbine shroud 100 shown in FIG. 8, FIG. 10 shows a front cross-sectional view of turbine shroud 100 taken along line CS2-CS2 in FIG. 7, and FIG. 11 shows a front cross-sectional view of turbine shroud 100 taken along line CS3-CS3 in FIG. 7.

As shown in FIGS. 8-11, turbine shroud 100 may include at least one plenum 200. Plenum 200 may be formed and/or extend through a portion of unitary body 102 of turbine shroud 100. More specifically, plenum 200 may extend (radially) through at least a portion of support portion 104 and intermediate portion 134, and/or seal portion 154 of unitary body 102. In the non-limiting example shown, plenum 200 may extend through the entirety of support portion 104, and intermediate portion 134, but only may extend through a portion of seal portion 154. In other non-limiting examples (not shown), plenum 200 may not extend into and/or (partially) through seal portion 154, but rather may end within intermediate portion 134. As shown in FIGS. 10 and 11, the portion of plenum 200 (shown in phantom) formed within intermediate portion 134 and seal portion 154 may extend between and/or adjacent opposing slash faces 120, 122. Although only a single plenum 200 is shown in FIGS. 8-11, it is understood that turbine shroud 100 may include more plenums (see, FIG. 13). As such, the number of plenums 200 depicted in the figures is merely illustrative.

In the non-limiting example, plenum 200 may be fluidly coupled to and/or in direct fluid communication with inlet opening(s) 168 formed in support portion 104. That is, and briefly returning to FIG. 7, plenum 200 may be in fluid communication with each inlet opening 168 formed in first surface 126 of support portion 104 for turbine shroud 100. As discussed herein, plenum 200 may receive cooling fluid (CF)(see, FIGS. 8, 10, and 11), via inlet opening(s) 168, flowing within turbine 28 and may provide the cooling fluid (CF) to distinct cooling passages formed in turbine shroud 100 to cool turbine shroud 100 during operation.

As shown in FIGS. 8-11, turbine shroud 100 may include a first cooling passage 202 formed, positioned, and/or extending within unitary body 102 of turbine shroud 100. More specifically, first cooling passage 202 of turbine shroud 100 may be positioned within and/or extend through seal portion 154 of unitary body 102, between and/or adjacent forward end 156 and aft end 158. Additionally, and as shown in FIGS. 10 and 11, first cooling passage 202 may extend through seal portion 154 of unitary body 102 between and/or adjacent opposing slash faces 120, 122. First cooling passage 202 may also be positioned within seal portion 154 radially between plenum 200 and HGP surface 160 of seal portion 154. In the non-limiting example shown in FIGS. 8 and 9, and as discussed herein, at least a portion of first cooling passage 202 may be radially aligned with plenum 200. Also as discussed herein, first cooling passage 202 may be in fluid communication with plenum 200.

First cooling passage 202 may include a plurality of distinct segments, sections, and/or parts. For example, first cooling passage 202 may include a central part 204 positioned and/or extending between a forward part 206, and an aft part 208. As shown in FIGS. 8 and 9, central part 204 of first cooling passage 202 may be centrally formed and/or positioned between forward end 156 and aft end 158 of seal portion 154 for unitary body 102. Forward part 206 of first cooling passage 202 may be formed and/or positioned directly adjacent forward end 156 of seal portion 154, and axially adjacent and/or axially upstream of central part 204. Similarly, aft part 208 of first cooling passage 202 may be formed and/or positioned directly adjacent aft end 158 of seal portion 154, opposite forward part 206. Additionally, aft part 208 may be formed axially adjacent and/or axially downstream of central part 204. In the non-limiting example, central part 204 may be formed in seal portion 154 in a predetermined axial position between forward end 156 and aft end 158 that requires the most cooling. That is, central part 204 may be radially aligned with an axial portion of HGP surface 160 of seal portion 154 that requires the most cooling and/or demands the largest heat exchange within turbine shroud 100 to improve operational efficiency of turbine 28 and/or the operational life of turbine shroud 100 within turbine 28, as discussed herein.

In the non-limiting example shown in FIGS. 8 and 9, each of the parts 204, 206, 208 of first cooling passage 202 may include distinct sizes or dimensions. Specifically, central part 204 of first cooling passage 202 may include a first dimension, forward part 206 may include a second dimension, and aft part 208 may include a third dimension. The first dimension of central part 204 of first cooling passage 202 may be larger than the third dimension of aft part 208, but smaller than the second dimension of forward part 206. The dimensions of first cooling passage 202, and its various parts 204, 206, 208, may be dependent on a variety of factors including, but not limited to, the size of turbine shroud 100, the thickness of the various walls forming seal portion 154, the cooling demand for turbine shroud 100, a desired cooling flow volume/rate to forward part 206/aft part 208 (and additional cooling passages discussed herein, and/or the geometry or shape of forward end 156 and/or aft end 158 of turbine shroud 100.

Plenum 200 and first cooling passage 202 formed in unitary body 102 of turbine shroud 100 may be separated by a first rib 210. That is, and as shown in FIGS. 8 and 9, first rib 210 may be formed in seal portion 154 of unitary body 102, between and may separate first cooling passage 202 and plenum 200. Similar to the other features discussed herein, first rib 210 may be formed integral with unitary body 102 of turbine shroud 100, and may be formed within seal portion 154 radially outward from HGP surface 160. Additionally, first rib 210 may extend within unitary body 102 between and may be formed integral with opposing slash faces 120, 122.

In order to provide first cooling passage 202 with cooling fluid, unitary body 102 of turbine shroud 100 may also include a first plurality of impingement openings 212 formed therethrough. That is, and as shown in FIGS. 8 and 9, unitary body 102 may include a first plurality of impingement openings 212 formed through first rib 210. The first plurality of impingement openings 212 formed through first rib 210 may fluidly couple plenum 200 and first cooling passage 202. As discussed herein, during operation of gas turbine system 10 (see, FIG. 1) cooling fluid may flow from plenum 200 through the first plurality of impingement openings 212 to first cooling passage 202 to substantially cool turbine shroud 100.

It is understood that the size and/or number of impingement openings 212 formed through first rib 210, as shown in FIGS. 8 and 9, is merely illustrative. As such, turbine shroud 100 may include larger or smaller impingement openings 212, and/or may include more or less impingement openings 212 formed therein. Additionally, although the first plurality of impingement openings 212 are shown to be substantially uniform in size and/or shape, it is understood that each of the first plurality of impingement openings 212 formed on turbine shroud 100 may include distinct sizes and/or shapes. The size, shapes, and/or number of impingement openings 212 formed in unitary body 102 of turbine shroud 100 may be dependent, at least in part on the operational characteristics (e.g., exposure temperature, exposure pressure, position within turbine casing 36, and the like) of gas turbine system 10 during operation. Additionally, or alternatively, the size, shapes, and/or number of impingement openings 212 may be dependent, at least in part on the characteristics (e.g., first rib 210 thickness, dimension of first cooling passage 202, volume of first cooling passage 202, dimension/volume of plenum 200 and so on) of turbine shroud 100/first cooling passage 202.

In addition to first cooling passage 202, turbine shroud 100 may also include a second cooling passage 218. Second cooling passage 218 may be formed, positioned, and/or extending within unitary body 102 of turbine shroud 100. That is, and as shown in FIGS. 8 and 9, second cooling passage 218 may extend within unitary body 102 of turbine shroud 100 adjacent forward end 156 of seal portion 154. Second cooling passage 218 may also be formed and/or extend within seal portion 154 of unitary body 102 between and/or adjacent opposing slash faces 120, 122. In the non-limiting example, second cooling passage 218 may be formed and/or extend within seal portion 154 of unitary body 102 adjacent central part 204 and forward part 206 of first cooling passage 202. More specifically, second cooling passage 218 may be positioned adjacent to and upstream of central part 204 of first cooling passage 202, and may also be positioned radially inward from forward part 206 of first cooling passage 202. In the non-limiting example, second cooling passage 218 may also be formed or positioned between forward part 206 of first cooling passage 202 and HGP surface 160 of seal portion 154.

Second cooling passage 218 may also be separated from forward part 206 of first cooling passage 202 by a second rib 220. That is, and as shown in FIGS. 8 and 9, second rib 220 may be formed between and may separate first cooling passage 202 and second cooling passage 218. Second rib 220 may be formed integral with unitary body 102 of turbine shroud 100, and may be formed adjacent forward end 156 of seal portion 154. Additionally, second rib 220 may extend within seal portion of unitary body 102 between and may be formed integral with opposing slash faces 120, 122 of unitary body 102.

Second cooling passage 218 of turbine shroud 100 may also be in fluid communication with and/or fluidly coupled to first cooling passage 202 of turbine shroud 100. More specifically, second cooling passage 218 may be in direct fluid communication with forward part 206 of first cooling passage 202. In the non-limiting example shown in FIGS. 8 and 9, seal portion 154 of unitary body 102 may include a second plurality of impingement openings 222 formed through second rib 220. The second plurality of impingement openings 222 formed through second rib 220 may fluidly couple first cooling passage 202, and more specifically forward part 206, and second cooling passage 218. As discussed herein, during operation of gas turbine system 10 (see, FIG. 1) cooling fluid flowing through forward part 206 of first cooling passage 202 may pass or flow through the second plurality of impingement openings 222 to second cooling passage 218 to substantially cool turbine shroud 100.

Similar to the first plurality of impingement openings 212, the size, shape, and/or number of the second plurality of impingement openings 222 formed through second rib 220, as shown in FIGS. 8 and 9, is merely illustrative. As such, turbine shroud 100 may include larger of smaller impingement openings 222, varying sized impingement openings 222, and/or may include more or less impingement openings 222 formed therein.

Also shown in FIGS. 8 and 9, unitary body 102 of turbine shroud 100 may include a plurality of forward exhaust holes 224. The plurality of forward exhaust holes 224 may be in fluid communication with second cooling passage 218. More specifically, each of the plurality of forward exhaust holes 224 may be in fluid communication with and may extend axially from second cooling passage 218 of turbine shroud 100. In the non-limiting example shown in FIGS. 8 and 9, the plurality of forward exhaust holes 224 may extend through unitary body 102, from second cooling passage 218 to forward end 156 of seal portion 154. That is, each of the plurality of forward exhaust holes 224 may be formed through forward end 156 of seal portion 154 and may extend axially through unitary body 102 to be fluidly coupled to second cooling passage 218. During operation, and as discussed herein, the plurality of forward exhaust holes 224 may discharge cooling fluid from second cooling passage 218, adjacent forward end 156 of seal portion 154, and into the hot gas flow path (FP) of combustion gases 26 flowing through turbine 28.

It is understood that the number of forward exhaust holes 224 shown in the non-limiting example of FIGS. 8 and 9 is merely illustrative. As such, forward end 156 of seal portion 154 may include more or less forward exhaust holes 224 than those shown in FIGS. 8 and 9. Additionally, although shown as being substantially rectangular and linear, it is understood that forward exhaust holes 224 may be substantially round and/or non-linear openings, channels and/or manifolds.

Also in the non-limiting example shown in FIGS. 8 and 9, unitary body 102 of turbine shroud 100 may also include a third cooling passage 226. Third cooling passage 226 may be formed, positioned, and/or extending within seal portion 154 of unitary body 102 for turbine shroud 100. That is, third cooling passage 226 may be extend within unitary body 102, adjacent aft end 158 of seal portion 154. Third cooling passage 226 may also be formed and/or extend within seal portion 154 of unitary body 102 between and/or adjacent opposing slash faces 120, 122. In the non-limiting example, third cooling passage 226 may be formed and/or extend within seal portion 154 adjacent central part 204 and aft part 208 of first cooling passage 202. More specifically, third cooling passage 226 may be positioned adjacent to and downstream of central part 204 of first cooling passage 202, and may also be positioned radially inward from aft part 208 of first cooling passage 202. In the non-limiting example, third cooling passage 226 may also be formed or positioned between aft part 208 of first cooling passage 202 and inner HGP surface 160 of seal portion 154.

Third cooling passage 226 may be separated from aft part 208 of first cooling passage 202 by a third rib 228. That is, and as shown in FIGS. 8 and 9, third rib 228 may be formed between and may separate first cooling passage 202 and third cooling passage 226. Third rib 228 may be formed integral with unitary body 102 of turbine shroud 100, and may be formed adjacent aft end 158 of seal portion 154. Additionally, third rib 228 may extend within seal portion 154 of unitary body 102 between and may be formed integral with opposing slash faces 120, 122 of unitary body 102.

Third cooling passage 226 of turbine shroud 100 may also be in fluid communication with and/or fluidly coupled to first cooling passage 202 of turbine shroud 100. More specifically, third cooling passage 226 may be in direct fluid communication with aft part 208 of first cooling passage 202. In the non-limiting example shown in FIGS. 8 and 9, seal portion 154 of unitary body 102 may include a third plurality of impingement openings 230 formed through third rib 228. The third plurality of impingement openings 230 formed through third rib 228 may fluidly couple first cooling passage 202, and more specifically aft part 208, and third cooling passage 226. As discussed herein, during operation of gas turbine system 10 (see, FIG. 1) cooling fluid flowing through aft part 208 of first cooling passage 202 may pass or flow through the third plurality of impingement openings 230 to third cooling passage 226 to substantially cool turbine shroud 100.

Similar to the second plurality of impingement openings 222, the size, shape, and/or number of the third plurality of impingement openings 230 formed through third rib 228 is merely illustrative, and may be dependent, at least in part, on the operational characteristics of gas turbine system 10 during operation, and/or the characteristics of turbine shroud 100/third cooling passage 226. As such, turbine shroud 100 may include more or less impingement openings 230 formed through third rib 228.

Also shown in FIGS. 8 and 9, turbine shroud 100 may include a plurality of aft exhaust holes 232. The plurality of aft exhaust holes 232 may be in fluid communication with third cooling passage 226. More specifically, each of the plurality of aft exhaust holes 232 may be in fluid communication with and may extend axially from third cooling passage 226 of turbine shroud 100. In the non-limiting example, the plurality of aft exhaust holes 232 may extend axially through unitary body 102, from third cooling passage 226 to aft end 158 of seal portion 154. That is, each of the plurality of aft exhaust holes 232 may be formed through aft end 158 of seal portion 154 and may extend axially through unitary body 102 to be fluidly coupled to third cooling passage 226. As discussed herein, the plurality of aft exhaust holes 232 may discharge cooling fluid from third cooling passage 226, adjacent aft end 158 of seal portion 154, and into the hot gas flow path (FP) of combustion gases 26 flowing through turbine 28.

Similar to the plurality of forward exhaust holes 224, it is understood that the number of aft exhaust holes 232 shown in the non-limiting example of FIGS. 8 and 9 is merely illustrative. As such, aft end 158 of seal portion 154 may include more or less aft exhaust holes 232 than those shown in FIGS. 8 and 9. Additionally, the shape of aft exhaust holes 232 (e.g., substantially rectangular and linear), is merely illustrative, and each of the plurality of exhaust holes 232 included in unitary body 102 may be formed in substantially distinct shapes (e.g., non-linear openings, channels and/or manifolds).

In addition to exhausting cooling fluid from forward end 156 and aft end 158 of seal portion 154, turbine shroud 100 may include additional features to exhaust cooling fluid from opposing slash faces 120, 122 of unitary body 102 for turbine shroud 100. Turning to FIGS. 10 and 11, and previously shown in FIGS. 5 and 6, unitary body 102 of turbine shroud 100 may include an exhaust channel 234 formed in each of the two opposing slash faces 120, 122. That is, each of first slash face 120 and second slash face 122 of unitary body 102 may include exhaust channel 234 formed therein, and substantially exposed on first slash face 120 and second slash face 122, respectively. Each exhaust channel 234 may extend axially over at least a portion of opposing slash faces 120, 122. In the non-limiting example shown in FIGS. 10 and 11, exhaust channels 234 may be formed and/or positioned radially outward from HGP seal slot 166, and/or may be formed and/or positioned radially between support portion 134 of unitary body 102 and HGP seal slot 166 formed in opposing slash faces 120, 122. Exhaust channel 234 may be fluid communication with first cooling passage 202. In the non-limiting example shown in FIG. 10, exhaust channel 234 may be in fluid communication with first cooling passage 202 via second cooling passage 218, and conduits 236, 238 discussed herein. During operation of gas turbine system 10 (see, FIG. 1) at least a portion of cooling fluid may be discharged from turbine shroud 100 through exhaust channel 234, radially outward from HGP seal slot 166.

Conduits 236, 238 formed in unitary body 102 for turbine shroud 100 may fluidly couple exhaust channel 234 to the cooling passages formed within seal portion 154 of unitary body 102. For example, and as shown in FIG. 10, a first conduit 236 may extend between and fluidly couple second cooling passage 218 and exhaust channel 234 formed in first slash face 120. First conduit 236 may be formed and/or extend through seal portion 154 of unitary body 102 from second cooling passage 218 toward first slash face 120 and may be in fluid communication with both second cooling passage 218 and exhaust channel 234 formed in first slash face 120. Additionally in the non-limiting example shown in FIG. 10, a second conduit 238 may extend between and fluidly couple second cooling passage 218 and exhaust channel 234 formed in second slash face 122. Second conduit 238 may be formed and/or extend through seal portion 154 of unitary body 102 from second cooling passage 218 toward second slash face 122, circumferentially opposite first conduit 236. Second conduit 238 may also be in fluid communication with both second cooling passage 218 and exhaust channel 234 formed in second slash face 122. Because first cooling passage 202, and more specifically forward part 206, is in fluid communication with second cooling passage 218, first cooling passage 202 in the non-limiting example may also be in fluid communication with conduits 236, 238 for providing cooling fluid to exhaust channel 234, as discussed herein.

In the non-limiting example shown in FIGS. 5, 6, 10 and 11, unitary body 102 of turbine shroud 100 may also include a plurality of slash face exhaust holes 240 (shown in phantom in FIG. 10). The plurality of slash face exhaust holes 240 may be formed in each of the two opposing slash faces 120, 122 of unitary body 102, between forward end 156 and aft end 158 of seal portion 154. That is, each of first slash face 120 and second slash face 122 of unitary body 102 may include the plurality of slash face exhaust holes 240 formed therein, and the plurality of slash face exhaust holes 240 may be substantially exposed on first slash face 120 and second slash face 122, respectively. In the non-limiting example shown in FIGS. 5, 6, 10, and 11, the plurality of slash face exhaust holes 240 may also be formed and/or positioned radially inward from HGP seal slot 166, and/or may be formed and/or positioned radially between HGP seal slot 166 formed in opposing slash faces 120, 122 and HGP surface 160 of seal portion 154. As discussed herein, the plurality of slash face exhaust holes 240 may be fluid communication with exhaust channel 234. During operation of gas turbine system 10 (see, FIG. 1) at least a portion of cooling fluid may be discharged from turbine shroud 100 through the plurality of slash face exhaust holes 240, radially inward from HGP seal slot 166, and into the flow path of combustion gases 26, as discussed herein. It is understood that the number of slash face exhaust holes 240 shown in the non-limiting example of FIGS. 5, 6, 10, and 11 is merely illustrative. As such, opposing slash faces 120, 122 of unitary body 102 may include more or less slash face exhaust holes 240 than those shown in the figures.

The plurality of slash face exhaust holes 240 may be fluid communication with and/or may be fluidly coupled to exhaust channel 234. In the non-limiting example shown in FIGS. 10 and 11, unitary body 102 may include a plurality of connection conduits 242 (shown in phantom in FIG. 10) fluidly coupling exhaust channel 234 and the plurality of slash face exhaust holes 240. The plurality of connection conduits 242 may be formed in seal portion 154 of unitary body 102, adjacent each of the two opposing slash faces 120, 122. That is, each of the plurality of connection conduits 242 may be formed in seal portion 154, adjacent either first slash face 120, or second slash face 122 of unitary body 102. Each of the plurality of connection conduits 242 may extend radially between, and may fluidly couple exhaust channels 234 and the plurality of slash face exhaust holes 240 formed in either of the opposing slash faces 120, 122. As discussed herein, during operation of gas turbine system 10 (see, FIG. 1) at least a portion of the cooling fluid provide to exhaust channels 234 via conduits 236, 238 may flow through the plurality of connection conduits 242, and subsequently provided to and exhausted from the plurality of slash face exhaust holes 240.

During operation of gas turbine system 10 (see, FIG. 1), cooling fluid may flow through unitary body 102 to cool turbine shroud 100. More specifically, as turbine shroud 100 is exposed to combustion gases 26 flowing through the hot gas flow path of turbine 28 (see, FIG. 2) during operation of gas turbine system 10 and increases in temperature, cooling fluid may be provided to and/or may flow through the various features (e.g., plenum 200, passages 202, 218, 226, exhaust channels 234, and the like) formed and/or extending through unitary body 102 to cool turbine shroud 100. In a non-limiting example, cooling fluid may first be provided to turbine shroud 100 adjacent support portion 104 of unitary body 102 from a distinct portion, feature and/or area of turbine 28. The cooling fluid may flow through inlet opening(s) 168 formed in first surface 126 of support portion 104 into plenum 200. In the non-limiting example shown in FIGS. 8-11 where unitary body 102 includes a single plenum 200, cooling fluid may flow radially through each inlet opening(s) 168 and may be collected and/or mix within plenum 200. Additionally where turbine shroud 100 includes metering plate 170 affixed to first surface 126, over and/or at least partially covering inlet opening(s) 168 (see, FIG. 7), metering plate 170 may regulate the amount of cooling fluid flowing through inlet opening(s) 168 to plenum 200, and/or the pressure in which the cooling fluid flows through inlet opening(s) 168 to plenum 200.

The cooling fluid may flow from inlet opening(s) 168, through plenum 200, toward HGP surface 160 of seal portion 154 and/or radially toward the cooling passages 202, 218, 226 formed within seal portion 154. More specifically, the cooling fluid provided to plenum 200 may flow radially toward first rib 210, and subsequently through the first plurality of impingement openings 212 to first cooling passage 202. In the non-limiting example, the cooling fluid may flow through the first plurality of impingement openings 212 formed in first rib 210 and may initially enter central part 204 of first cooling passage 202. The cooling fluid flowing into/through central part 204 of first cooling passage 202 may cool and/or receive heat from HGP surface 160 of seal portion 154 for turbine shroud 100. As discussed herein, the cooling fluid flowing through central part 204 may cool an axial portion of HGP surface 160 of seal portion 154 that requires the most cooling and/or demands the largest heat exchange within turbine shroud 100. Once inside first cooling passage 202, the cooling fluid may be dispersed and/or may flow axially toward one of forward end 156 or aft end 158 of seal portion 154. More specifically, the cooling fluid in central part 204 of first cooling passage 202 may flow axially into forward part 206 of first cooling passage 202 or aft part 208 of first cooling passage 202. The cooling fluid may flow to the respect part 206, 208 of first cooling passage 202 and/or end 156, 158 of seal portion 154 of unitary body 102 as a result of, for example, the internal pressure within first cooling passage 202.

Once the cooling fluid has flowed to the respect part 206, 208 of first cooling passage 202 and/or end 156, 158 of seal portion 154, the cooling fluid may flow to distinct cooling passages 218, 226 formed and/or extending within unitary body 102 of turbine shroud 100 to continue to cool turbine shroud 100 and/or receive heat. For example, the portion of cooling fluid that flows to forward end 156 of seal portion 154 and/or forward part 206 of first cooling passage 202 may subsequently flow to second cooling passage 218. The cooling fluid may flow from forward part 206 of first cooling passage 202 to second cooling passage 218 via the second plurality of impingement openings 222 formed through second rib 220 of unitary body 102. Once inside second cooling passage 218, the cooling fluid may continue to cool turbine shroud 100 and/or receive/dissipate heat from turbine shroud 100. Simultaneously, the distinct portion of cooling fluid that flows to aft end 158 of seal portion 154 and/or aft part 208 of first cooling passage 202 may subsequently flow to third cooling passage 226. The cooling fluid may flow from aft part 208 of first cooling passage 202 to third cooling passage 226 via the third plurality of impingement openings 230 formed through third rib 228 of unitary body 102. Once inside third cooling passage 226, the cooling fluid may continue to cool turbine shroud 100 and/or receive/dissipate heat from turbine shroud 100.

From second cooling passage 218, a portion of the cooling fluid may flow through the plurality of forward exhaust holes 224, exhaust adjacent forward end 156 of seal portion 154, and into the hot gas flow path of combustion gases 26 flowing through turbine 28 (see, FIG. 2). Additionally, a portion of the cooling fluid included in the third cooling passage 226 may flow through plurality of aft exhaust holes 232, exhaust adjacent aft end 158 of seal portion 154, and finally flow into the hot gas flow path of combustion gases 26 flowing through turbine 28 (see, FIG. 2).

Distinct portions of the cooling fluid not exhausted from forward exhaust holes 224 or aft exhaust holes 232 may be provided to other features of turbine shroud 100. For example, a distinct portion of cooling fluid flowing in second cooling passage 218 may be provided to exhaust channel 234. More specifically, the distinct portion of cooling fluid may flow from second cooling passage 218 to conduits 236, 238, and may subsequently be provided to exhaust channels 234 formed in opposing slash faces 120, 122 of unitary body 102 of turbine shroud 100. Conduits 236, 238 may flow the cooling fluid to exhaust channels 234, and at least some of the cooling fluid provided to exhaust channels 234 may be exhausted from exhaust channels 234 radially outward of and/or over HGP seal slot 166 and the seal component (not shown) positioned therein. The cooling fluid exhausted from exhaust channels 234 may be exhausted into a cooling fluid discharge area that is separated from the flow path of combustion gases 26 by the seal component positioned within HGP seal slot 166.

Additionally in the non-limiting example, some of cooling fluid provided to exhaust channels 234 may be provided to the plurality of connection conduits 242 extending between and fluidly coupling exhaust channel 234 and the plurality of slash face exhaust holes 240 formed in opposing slash faces 120, 122. The plurality of connection conduits 242 may flow the cooling fluid from exhaust channel 234 to each of the plurality of slash face exhaust holes 240, which in turn may exhaust the cooling fluid radially inward of and/or under HGP seal slot 166 and the seal component (not shown) positioned therein. The cooling fluid exhausted from the plurality of slash face exhaust holes 240 may be exhausted into the flow path of combustion gases 26 for turbine 28, similar to the cooling fluid discharged from forward exhaust holes 224 and/or aft exhaust holes 232.

Figure 12:
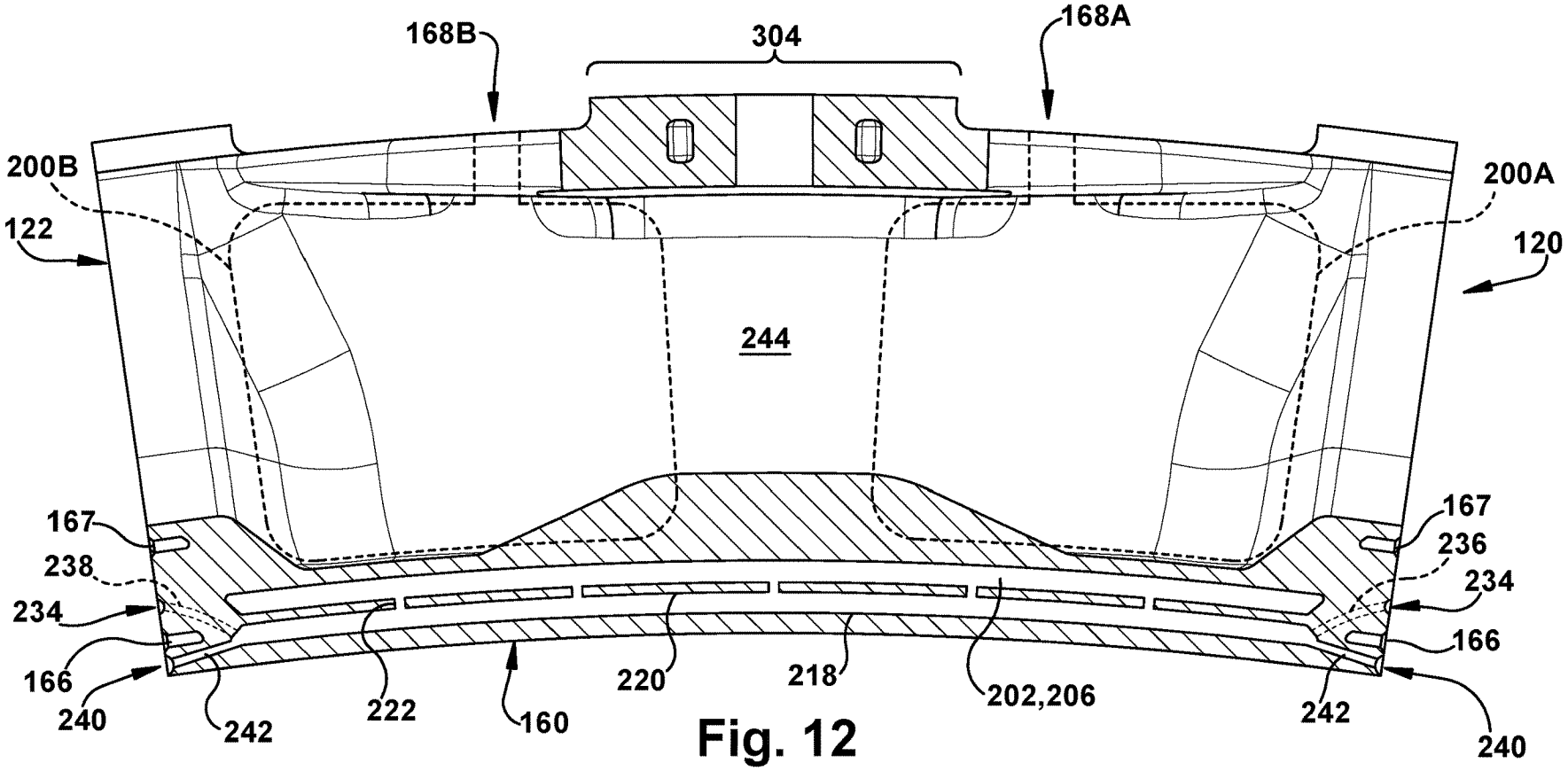
FIG. 12 shows a front cross-sectional view of the turbine shroud of FIG. 7 taken along line CS3-CS3, according to additional embodiments of the disclosure.

FIG. 12 shows another non-limiting example of turbine shroud 100. Specifically, FIG. 12 shows a front cross-sectional view of turbine shroud 100, similar to the cross-sectional view of FIG. 11 taken along line CS3-CS3 in FIG. 7. It is understood that similarly numbered and/or named components may function in a substantially similar fashion. Redundant explanation of these components has been omitted for clarity.

As shown in FIG. 12, unitary body 102 of turbine shroud 100 may include a plurality of plenums 200A, 200B (shown in phantom). In the non-limiting example, turbine shroud 100 may include two distinct plenums 200A, 200B formed therein, and separated by a wall 244. Both plenums 200A, 200B may extend (radially) through at least a portion of support portion 104, intermediate portion 134, and seal portion 154 of unitary body 102. First plenum 200A may also extend and/or be formed circumferentially between wall 244 and first slash face 120, and second plenum 200B may extend and/or be formed circumferentially between wall 244 and second slash face 122. Additionally, first plenum 200A may be in be fluidly coupled to and/or in direct fluid communication with inlet opening 168A formed in support portion 104, and second plenum 200B may be in be fluidly coupled to and/or in direct fluid communication with inlet opening 168B formed in support portion 104. Similar to plenum 200 discussed herein with respect to FIGS. 8-11, first plenum 200A and second plenum 200B may each be in fluid communication with and/or fluidly coupled to first cooling passage 202 (e.g., central part 204) via the first plurality of impingement openings 212 formed through first rib 210 (see e.g., FIG. 8). During operation of turbine system 10 (see, FIG. 1), the cooling fluid provided to first plenum 200A, and the separate cooling fluid provided to second plenum 200B may all flow to and/or combine within first cooling passage 202.

Additionally as shown in FIG. 12, and distinct from FIG. 11, the plurality of connection conduits 242 may not extend between and fluidly couple exhaust channels 234 and the plurality of slash face exhaust holes 240. Rather in the non-limiting example, each of the plurality connection conduits 242 may directly fluidly couple second cooling passage 218 formed within seal portion 154 of unitary body 102 and the plurality of slash face exhaust holes 240. For example, and as shown in FIG. 12, connection conduits 242 may extend (circumferentially) between and fluidly couple second cooling passage 218 and the plurality of slash face exhaust holes 240 formed in first slash face 120, or second slash face 122. In this non-limiting example, exhaust channels 234 may be in fluid communication with second cooling passage 218 using conduits 236, 238, as similarly discussed herein with respect to FIG. 10, but may not be in fluid communication with the plurality of slash face exhaust holes 240. As such, a portion of cooling fluid included in second cooling passage 218 may either flow directly to exhaust channels 234 via conduits 236, 238 or directly to slash face exhaust holes 240 via connection conduits 242.

Figure 13:
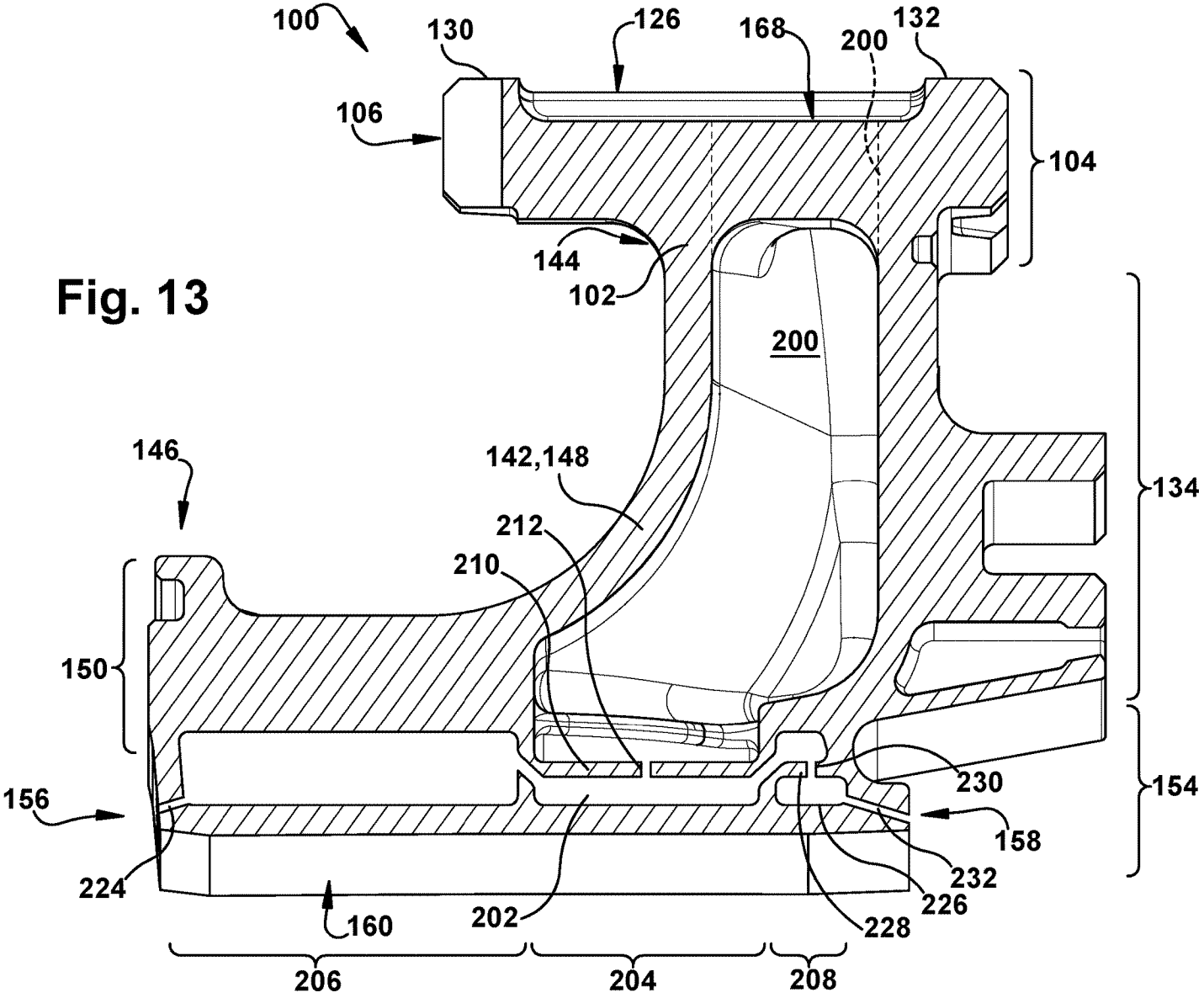
FIG. 13 shows a side cross-sectional view of the turbine shroud of FIG. 7 taken along line CS1-CS1, according to further embodiments of the disclosure.
Figure 14:
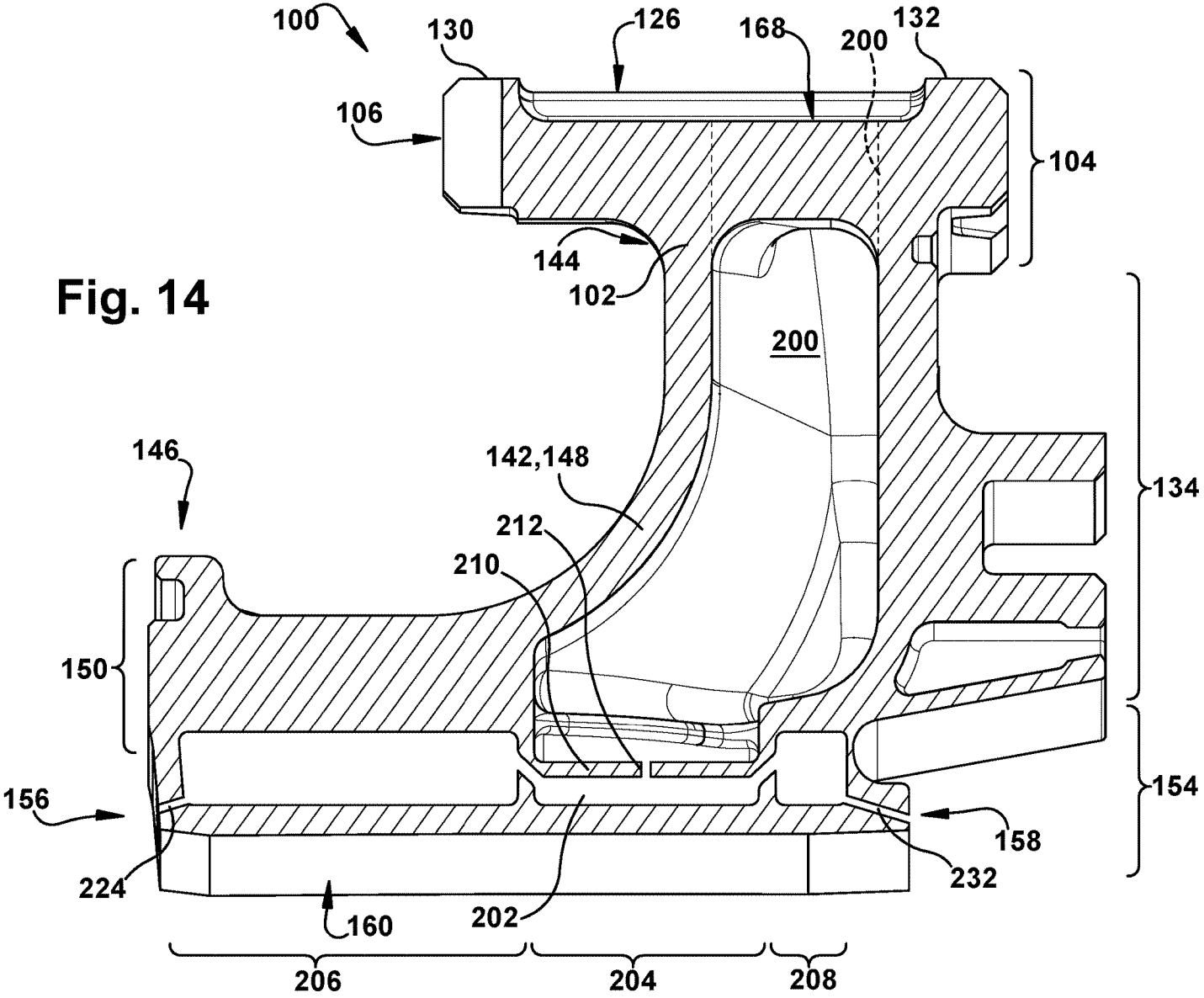
FIG. 14 shows a side cross-sectional view of the turbine shroud of FIG. 7 taken along line CS1-CS1, according to another embodiment of the disclosure.

FIGS. 13 and 14 show additionally non-limiting examples of turbine shroud 100. More specifically, FIG. 13 shows a side cross-sectional view of another non-limiting example of turbine shroud 100 similar to the cross-sectional view of FIG. 8 taken along line CS1-CS1 in FIG. 7, and FIG. 14 shows a side cross-sectional view of a further non-limiting example of turbine shroud 11 similar to the cross-sectional view of FIG. 8 taken along line CS1-CS1 in FIG. 7. It is understood that similarly numbered and/or named components may function in a substantially similar fashion. Redundant explanation of these components has been omitted for clarity.

In both non-limiting examples shown in FIGS. 13 and 14, turbine shroud 100 may not include second cooling passage 218 formed and/or extending adjacent forward end 156 of seal portion 154. Unitary body 102 of turbine shroud 100 not including second cooling passage 218 may also not include second rib 220 and the second plurality of impingement openings 222, respectively. Rather, and as shown in FIGS. 13 and 14, forward part 206 of first cooling passage 202 may extend substantially adjacent forward end 156 of seal portion 154 and radially between forward segment 150 of support portion 134 and HGP surface 160 of seal portion 154.

Additionally in the non-limiting example shown in FIG. 13, forward exhaust holes 224 may be in direct fluid communication with and/or fluidly coupled to first cooling passage 202, and more specifically forward part 206 of first cooling passage 202, and may extend through unitary body 102 from first cooling passage 202 to forward end 156 of seal portion 154 for turbine shroud 100.

Distinct from the non-limiting example shown in FIG. 13, FIG. 14 turbine shroud 100 may only include first cooling passage 202. That is, in the non-limiting example shown in FIG. 14, turbine shroud 100 may not include second cooling passage 218 formed and/or extending adjacent forward end 156 of seal portion 154, or third cooling passage 226 formed and/or extending adjacent aft end 158 of seal portion 154. Unitary body 102 of turbine shroud 100 not including third cooling passage 226 may also not include third rib 228 and the third plurality of impingement openings 230, respectively. Rather, and as shown in FIG. 14, aft part 208 of first cooling passage 202 may extend substantially adjacent aft end 158 of seal portion 154 and radially between aft segment 136 of support portion 134 and HGP surface 160 of seal portion 154.

Similar to the forward exhaust holes 224 discussed herein with respect to FIG. 13, aft exhaust holes 232 shown in FIG. 14 may be in direct fluid communication with and/or fluidly coupled to first cooling passage 202, and more specifically aft part 208 of first cooling passage 202. Aft exhaust holes 232 may extend through unitary body 102 from first cooling passage 202 to aft end 158 of seal portion 154 for turbine shroud 100. Additionally in the non-limiting example shown in FIG. 14, turbine shroud 100 may also not include forward exhaust holes 224. In this non-limiting example, and as discussed herein, all cooling fluid provided to forward part 206 of first cooling passage 202 may be provided to exhaust channels 234 and/or the plurality of slash face exhaust holes 204.

Figure 15:
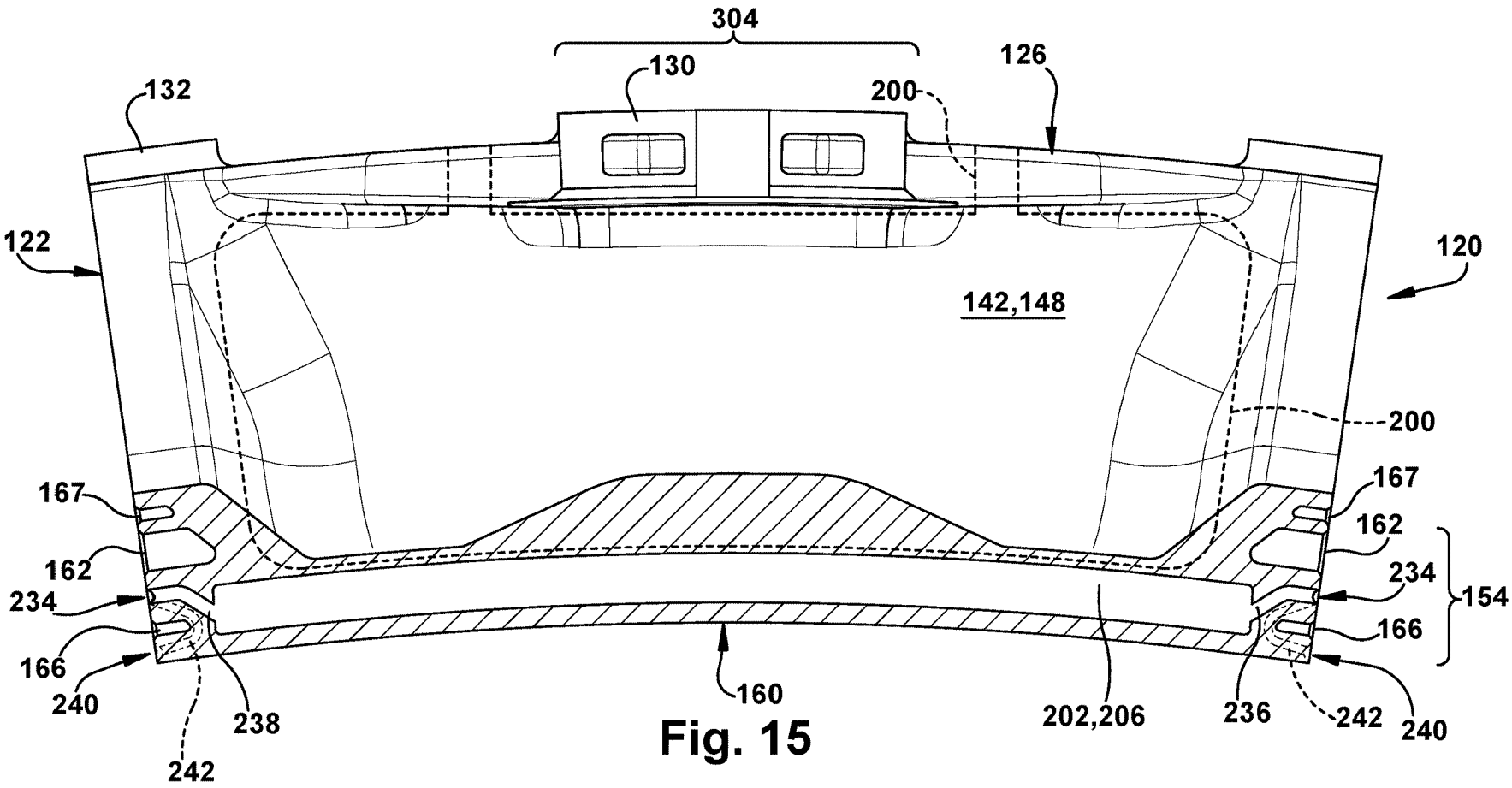
FIG. 15 shows a front cross-sectional view of the turbine shroud of FIG. 14, according to embodiments of the disclosure.

FIG. 15 shows a front cross-sectional view of turbine shroud 100, similar to the cross-sectional view of FIG. 10 taken along line CS2-CS2 in FIG. 7. The non-limiting example of turbine shroud 100 shown in FIG. 15 may represent turbine shroud 100 shown in either FIG. 13 or 14. As such in FIG. 15, and similarly discussed herein with respect to FIGS. 13 and 14, turbine shroud 100 may not include second cooling passage 218. Rather, forward part 206 of first cooling passage 202 may extend substantially adjacent forward end 156 of seal portion 154 and radially between forward segment 150 of support portion 134 and HGP surface 160 of seal portion 154. As a result, conduits 236, 238 may be in direct fluid communication with and/or may fluidly couple first cooling passage 202 to exhaust channels 234. For example, first conduit 236 may extend between and fluidly couple forward part 206 of first cooling passage 202 and exhaust channel 234 formed in first slash face 120. First conduit 236 may be formed and/or extend through seal portion 154 of unitary body 102 from forward part 206 of first cooling passage 202 toward first slash face 120 and may be in fluid communication with both forward part 206 of first cooling passage 202 and exhaust channel 234 formed in first slash face 120. Additionally in the non-limiting example shown in FIG. 15, second conduit 238 may extend between and fluidly couple forward part 206 of first cooling passage 202 and exhaust channel 234 formed in second slash face 122. Second conduit 238 may be formed and/or extend through seal portion 154 of unitary body 102 from forward part 206 of first cooling passage 202 toward second slash face 122, circumferentially opposite first conduit 236. Second conduit 238 may also be in fluid communication with both forward part 206 of first cooling passage 202 and exhaust channel 234 formed in second slash face 122. In this non-limiting example, forward part 206 of first cooling passage 202 may provide cooling fluid directly to exhaust channels 234 via conduits 236, 238.

FIG. 16 shows an enlarged side view of turbine 28 including a single stage of turbine blades 38, two stages of state vanes 40A, 40B surround the single stage of turbine blades 38, and turbine shroud 100. It is understood that similarly numbered and/or named components may function in a substantially similar fashion. Redundant explanation of these components has been omitted for clarity.

In the non-limiting example shown in FIG. 16, turbine shroud 100 may be directly coupled to casing 36 of turbine 28. That is, turbine shroud 100 may be coupled to casing 36 and/or extension 52 of casing 36, radially adjacent and/or outward from tip portion 48 of airfoil 46 for turbine blades 38. In the non-limiting example, support portion 104 of unitary body 102 for turbine shroud 100 may be positioned within and/or received by opening 54 of extension 52. Additionally, forward hook(s) 130 formed integral with forward end 106 and aft hook(s) 132 formed integral with aft end 108 of support portion 104 may be positioned within opening 54 of extension 52, and may engage a portion of extension 52 to secure, fix, and/or couple turbine shroud 100 to casing 36 of turbine 28.

As discussed herein, forward segment 150 of intermediate portion 134 for unitary body 102 may utilized to secure stator vanes 40A within casing 36. For example, forward segment 150 may abut, contact, hold, and/or be positioned axially adjacent an upstream stage of stator vanes 40A included within turbine 28. In the non-limiting example shown in FIG. 16, forward segment 150, along with a retention seal 172 positioned and/or secured within shelf 152, may abut, contact, and/or provide a compressive force against a securing component 56, which may contact and/or be coupled to a platform 42A of stator vane 40A positioned upstream of turbine shroud 100.

Additionally as discussed herein, features formed on aft segment 136 of intermediate portion 134 may also aid and/or be used to secure stator vanes 40B within casing 36. For example, a portion of platform 42B of stator vane 40B positioned axially downstream of turbine shroud 100 may be positioned on flange 138, and/or secured between flanges 138, 140 formed integral with and extending (axially) from aft section 136 of intermediate portion 134. In the non-limiting example, the portion of platform 42B of stator vane 40B may be positioned between flanges 138, 140, and/or rest on flange 138 (or flange 140 for turbine shrouds positioned radially below rotor 30 (see, FIG. 2)) to secure and/or fix stator vanes 40B within turbine casing 36 of turbine 28. To aid in securing stator vanes 40B within casing 36 and/or coupling platform 42B to turbine shroud 100, another retention seal 172 may be positioned between flanges 138, 140, and may contact the portion of platform 42B positioned between flanges 138, 140 of turbine shroud 100.

As discussed herein with respect to FIGS. 3-7, forward segment 150 of intermediate portion 134 and forward end 156 of seal portion 154 may extend axially upstream of the other portions and/or features of unitary body 102 for turbine shroud 100, and/or may be the axially-forward most portion of unitary body 102. That is, and as shown in FIG. 16, when turbine shroud 100 including unitary body 102 is positioned within turbine casing 36 for turbine 28, forward segment 150 of intermediate portion 134 and forward end 156 of seal portion 154 may be positioned axially upstream of forward end 106 of support portion 104, as well as the remaining portions/features of support portion 106. Additionally as shown in FIG. 16, forward segment 150 of intermediate portion 134 and forward end 156 of seal portion 154 may be positioned axially upstream of non-linear segment 142 of intermediate portion 134, as well as the remaining portion/features of intermediate portion 134. Forward segment 150 of intermediate portion 134 and forward end 156 of seal portion 154 may also be positioned axially upstream of all additional portions/features (e.g., HGP surface 160) of seal portion 154. In the non-limiting example, forward segment 150 of intermediate portion 134 and forward end 156 of seal portion 154 may be positioned axially upstream of extension 52 of turbine casing 36 as well. Because unitary body 102 includes support 104 and intermediate portion 134 having non-linear segment 142, forward segment 150 and forward end 156 may be positioned axially upstream of support portion 104 in a substantially cantilever manner or fashion without being directly coupled or connected to, and/or being formed integral with support portion 104. As a result, and as discussed herein, forward segment and forward end 156 may thermally expand during operation of turbine 28 without causing undesirable mechanical stress or strain on other portions (e.g., support portion 104, intermediate portion 134) of turbine shroud 100.

Turbine shroud 100 may be formed in a number of ways. In one embodiment, turbine shroud 100 may be made by casting. However, as noted herein, additive manufacturing is particularly suited for manufacturing turbine shroud 100 including unitary body 102. As used herein, additive manufacturing (AM) may include any process of producing an object through the successive layering of material rather than the removal of material, which is the case with conventional processes. Additive manufacturing can create complex geometries without the use of any sort of tools, molds or fixtures, and with little or no waste material. Instead of machining components from solid billets of plastic or metal, much of which is cut away and discarded, the only material used in additive manufacturing is what is required to shape the part. Additive manufacturing processes may include but are not limited to: 3D printing, rapid prototyping (RP), direct digital manufacturing (DDM), binder jetting, selective laser melting (SLM) and direct metal laser melting (DMLM). In the current setting, DMLM or SLM have been found advantageous.

Figure 17:
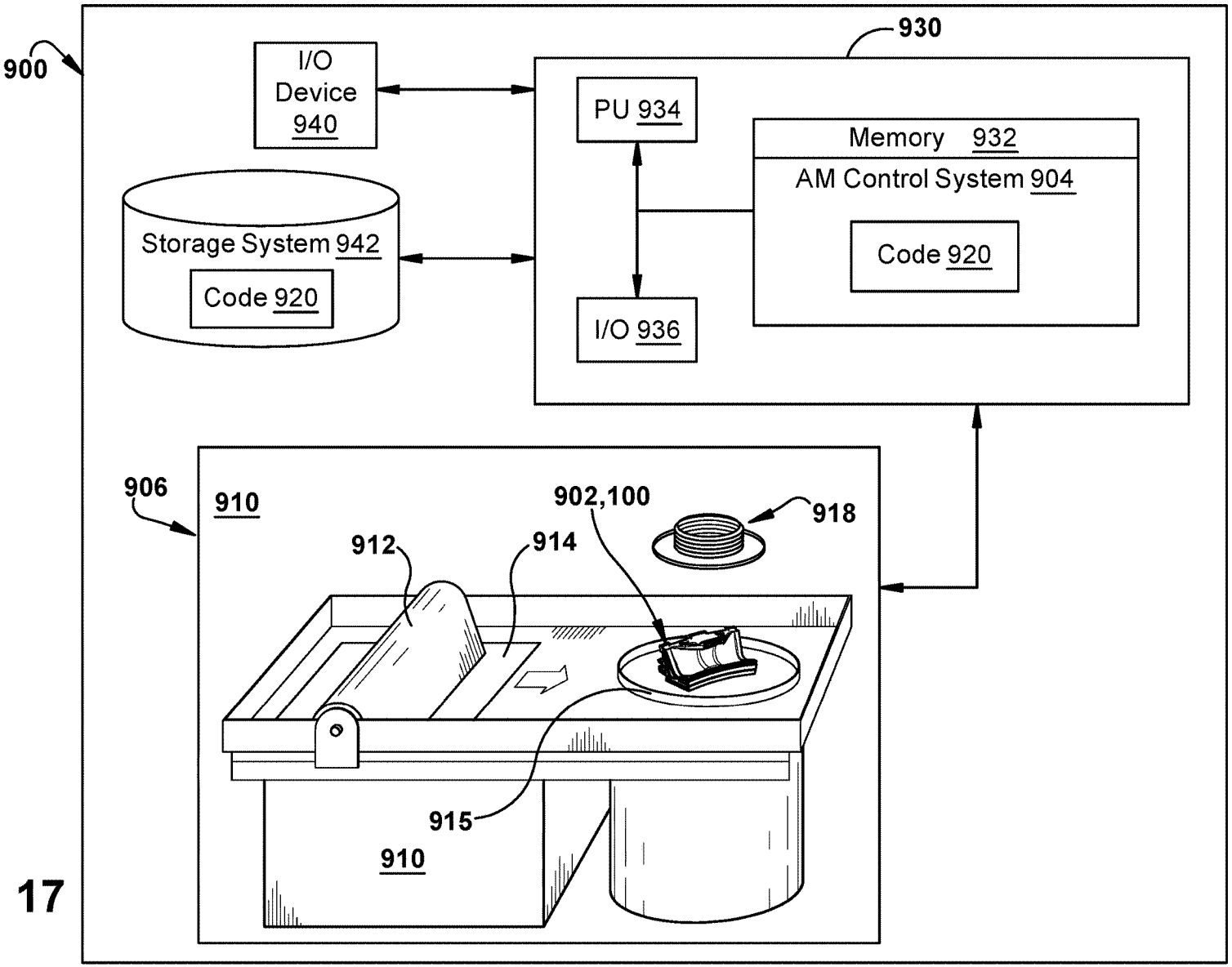
FIG. 17 shows a block diagram of an additive manufacturing process including a non-transitory computer readable storage medium storing code representative of a turbine shroud according to embodiments of the disclosure.

To illustrate an example of an additive manufacturing process, FIG. 17 shows a schematic/block view of an illustrative computerized additive manufacturing system 900 for generating an object 902. In this example, system 900 is arranged for DMLM. It is understood that the general teachings of the disclosure are equally applicable to other forms of additive manufacturing. Object 902 is illustrated as turbine shroud 100 (see, FIGS. 2-15). AM system 900 generally includes a computerized additive manufacturing (AM) control system 904 and an AM printer 906. AM system 900, as will be described, executes code 920 that includes a set of computer-executable instructions defining turbine shroud 100 to physically generate the object 902 using AM printer 906. Each AM process may use different raw materials in the form of, for example, fine-grain powder, liquid (e.g., polymers), sheet, etc., a stock of which may be held in a chamber 910 of AM printer 906. In the instant case, turbine shroud 100 may be made of a metal or metal compound capable of withstanding the environment of gas turbine system 10 (see, FIG. 1). As illustrated, an applicator 912 may create a thin layer of raw material 914 spread out as the blank canvas on a build plate 915 of AM printer 906 from which each successive slice of the final object will be created. In other cases, applicator 912 may directly apply or print the next layer onto a previous layer as defined by code 920, e.g., where a metal binder jetting process is used. In the example shown, a laser or electron beam 916 fuses particles for each slice, as defined by code 920, but this may not be necessary where a quick setting liquid plastic/polymer is employed. Various parts of AM printer 906 may move to accommodate the addition of each new layer, e.g., a build platform 918 may lower and/or chamber 910 and/or applicator 912 may rise after each layer.

AM control system 904 is shown implemented on computer 930 as computer program code. To this extent, computer 930 is shown including a memory 932, a processor 934, an input/output (I/O) interface 936, and a bus 938. Further, computer 930 is shown in communication with an external I/O device/resource 940 and a storage system 942. In general, processor 934 executes computer program code, such as AM control system 904, that is stored in memory 932 and/or storage system 942 under instructions from code 920 representative of turbine shroud 100, described herein. While executing computer program code, processor 934 can read and/or write data to/from memory 932, storage system 942, I/O device 940 and/or AM printer 906. Bus 938 provides a communication link between each of the components in computer 930, and I/O device 940 can comprise any device that enables a user to interact with computer 940 (e.g., keyboard, pointing device, display, etc.). Computer 930 is only representative of various possible combinations of hardware and software. For example, processor 934 may comprise a single processing unit, or be distributed across one or more processing units in one or more locations, e.g., on a client and server. Similarly, memory 932 and/or storage system 942 may reside at one or more physical locations. Memory 932 and/or storage system 942 can comprise any combination of various types of non-transitory computer readable storage medium including magnetic media, optical media, random access memory (RAM), read only memory (ROM), etc. Computer 930 can comprise any type of computing device such as a network server, a desktop computer, a laptop, a handheld device, a mobile phone, a pager, a personal data assistant, etc.

Additive manufacturing processes begin with a non-transitory computer readable storage medium (e.g., memory 932, storage system 942, etc.) storing code 920 representative of turbine shroud 100. As noted, code 920 includes a set of computer-executable instructions defining outer electrode that can be used to physically generate the tip, upon execution of the code by system 900. For example, code 920 may include a precisely defined 3D model of turbine shroud 100 and can be generated from any of a large variety of well-known computer aided design (CAD) software systems such as AutoCAD®, TurboCAD®, DesignCAD 3D Max, etc. In this regard, code 920 can take any now known or later developed file format. For example, code 920 may be in the Standard Tessellation Language (STL) which was created for stereolithography CAD programs of 3D Systems, or an additive manufacturing file (AMF), which is an American Society of Mechanical Engineers (ASME) standard that is an extensible markup-language (XML) based format designed to allow any CAD software to describe the shape and composition of any three-dimensional object to be fabricated on any AM printer. Code 920 may be translated between different formats, converted into a set of data signals and transmitted, received as a set of data signals and converted to code, stored, etc., as necessary. Code 920 may be an input to system 900 and may come from a part designer, an intellectual property (IP) provider, a design company, the operator or owner of system 900, or from other sources. In any event, AM control system 904 executes code 920, dividing turbine shroud 100 into a series of thin slices that it assembles using AM printer 906 in successive layers of liquid, powder, sheet or other material. In the DMLM example, each layer is melted to the exact geometry defined by code 920 and fused to the preceding layer. Subsequently, the turbine shroud 100 may be exposed to any variety of finishing processes, e.g., those described herein for re-contouring or other minor machining, sealing, polishing, etc.

Technical effects of the disclosure include, e.g., providing a turbine shroud formed from a unitary body that includes the hot gas path surface as well as a portion that may be coupled directly to the turbine casing if the turbine system. The unitary body of the turbine shroud (formed using additive manufacturing) also includes a plurality of internal cooling plenums and passages to cool the turbine shroud during operation.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. "Approximately" as applied to a particular value of a range applies to both values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A turbine shroud for a turbine system, the turbine shroud comprising:

a unitary body including:

a support portion coupled directly to a turbine casing of the turbine system;

an intermediate portion integral with and extending away from the support portion;

a seal portion integral with the intermediate portion, opposite the support portion, the seal portion including a forward end, an aft end positioned opposite the forward end, and a hot gas path (HGP) surface extending between the forward end and aft end;

two opposing slash faces extending adjacent to and between the support portion and the HGP surface of the seal portion, the two opposing slash faces positioned opposite one another;

a hot gas path (HGP) seal slot formed on each of the two opposing slash faces;

at least one inlet opening formed in the support portion;

at least one plenum in fluid communication with the at least one inlet opening, the at least one plenum extending through the support portion and the intermediate portion;

a first cooling passage extending through the seal portion, between the forward end and the aft end of the seal portion, the first cooling passage positioned between the at least one plenum and the HGP surface of the seal portion, and the first cooling passage in fluid communication with the at least one plenum;

an exhaust channel formed in each of the two opposing slash faces, between the support portion and the HGP seal slot, the exhaust channel in fluid communication with the first cooling passage; and a plurality of slash face exhaust holes formed in each of the two opposing slash faces, between the HGP surface of the seal portion and the HGP seal slot, the plurality of slash face exhaust holes in fluid communication with the exhaust channel.

2. The turbine shroud of claim 1, wherein the unitary body further includes:

a plurality of connection conduits formed in the seal portion, adjacent each of the two opposing slash faces, each of the plurality of connection conduits extending between and fluidly coupling the exhaust channel and the plurality of slash face exhaust holes formed in each of the two opposing slash faces.

3. The turbine shroud of claim 1, wherein the first cooling passage of the unitary body further includes:

a forward part positioned adjacent the forward end of the seal portion, an aft part positioned adjacent the aft end of the seal portion, and a central part positioned between the forward part and the aft part.

4. The turbine shroud of claim 3, wherein the unitary body further includes:

a first conduit extending between and fluidly coupling the forward part of the cooling passage and the exhaust channel formed in one of the two opposing slash faces; and a second conduit extending between and fluidly coupling the forward part of the cooling passage and the exhaust channel formed in the other of the two opposing slash faces, opposite the first conduit.

5. The turbine shroud of claim 3, wherein the unitary body further includes at least one of:

a second cooling passage extending within the unitary body adjacent the forward end of the seal portion, the second cooling passage in direct fluid communication with the forward part of the first cooling passage, or a third cooling passage extending within the unitary body adjacent the aft end of the seal portion, the third cooling passage in direct fluid communication with the aft part of the first cooling passage.

6. The turbine shroud of claim 5, wherein the unitary body further includes:

a first conduit extending between and fluidly coupling the second cooling passage and the exhaust channel formed in one of the two opposing slash faces; and a second conduit extending between and fluidly coupling the second cooling passage and the exhaust channel formed in the other of the two opposing slash faces, opposite the first conduit.

7. The turbine shroud of claim 5, wherein the unitary body further includes:

a first rib formed in the seal portion, the first rib positioned between and separating the at least one plenum and the first cooling passage; and at least one of:

a second rib formed adjacent the forward end of the seal portion, the second rib positioned between and separating the forward part of the first cooling passage and the second cooling passage, or a third rib formed adjacent the aft end of the seal portion, the third rib positioned between and separating the aft part of the first cooling passage and the third cooling passage.

8. The turbine shroud of claim 7, wherein the unitary body further includes:

a first plurality of impingement openings formed through the first rib to fluidly couple the first cooling passage to the at least one plenum; and at least one of:

a second plurality of impingement openings formed through the second rib, the second plurality of impingement openings fluidly coupling the forward part of the first cooling passage and the second cooling passage, or a third plurality of impingement openings formed through the third rib, the third plurality of impingement openings fluidly coupling the aft part of the first cooling passage and the third cooling passage.

9. The turbine shroud of claim 5, wherein the unitary body further includes:

a plurality of forward exhaust holes formed through the forward end of the seal portion, each of the plurality of forward exhaust holes in fluid communication with the second cooling passage.

10. The turbine shroud of claim 5, wherein the unitary body further includes:

a plurality of aft exhaust holes formed through the aft end of the seal portion, each of the plurality of aft exhaust holes in fluid communication with the third cooling passage.

11. The turbine shroud of claim 1, wherein the at least one plenum further extends through at least a portion of the seal portion.

12. A turbine system comprising:

a turbine casing;

a rotor extending axially through the turbine casing;

a plurality of turbine blades positioned circumferentially about and extending radially from the rotor; and a plurality of turbine shrouds directly coupled to the turbine casing and positioned radially between the turbine casing and the plurality of turbine blades, each of the plurality of turbine shrouds including:

a unitary body including:

a support portion coupled directly to the turbine casing;

an intermediate portion integral with and extending radially from the support portion;

a seal portion integral with the intermediate portion, radially opposite the support portion, the seal portion including a forward end, an aft end positioned opposite the forward end, and a hot gas path (HGP) surface extending between the forward end and aft end;

two opposing slash faces extending adjacent to and radially between the support portion and the HGP surface of the seal portion, the two opposing slash faces positioned opposite one another;

a hot gas path (HGP) seal slot formed on each of the two opposing slash faces;

at least one inlet opening formed in the support portion;

at least one plenum in fluid communication with the at least one inlet opening, the at least one plenum extending radially through the support portion and the intermediate portion;

a first cooling passage extending through the seal portion, between the forward end and the aft end of the seal portion, the first cooling passage positioned radially between the at least one plenum and the HGP surface of the seal portion, and the first cooling passage in fluid communication with the at least one plenum;

an exhaust channel formed in each of the two opposing slash faces, radially between the support portion and the HGP seal slot, the exhaust channel in fluid communication with the first cooling passage; and a plurality of slash face exhaust holes formed in each of the two opposing slash faces, radially between the HGP surface of the seal portion and the HGP seal slot, the plurality of slash face exhaust holes in fluid communication with the exhaust channel.

13. The turbine system of claim 12, wherein the unitary body for each of the plurality of turbine shrouds further includes:

a plurality of connection conduits formed in the seal portion, adjacent each of the two opposing slash faces, each of the plurality of connection conduits extending between and fluidly coupling the exhaust channel and the plurality of slash face exhaust holes formed in each of the two opposing slash faces.

14. The turbine system of claim 12, the unitary body for each of the plurality of turbine shrouds further includes:

a meter plate affixed to the support portion, the meter plate positioned over the at least one inlet opening formed in the support portion to regulate the flow of a cooling fluid provided to the at least one plenum.

15. The turbine system of claim 12, wherein the first cooling passage of the unitary body for each of the plurality of turbine shrouds further includes:

a forward part positioned adjacent the forward end of the seal portion, an aft part positioned adjacent the aft end of the seal portion, and a central part positioned between the forward part and the aft part.

16. The turbine system of claim 15, wherein the unitary body for each of the plurality of turbine shrouds further includes:

a first conduit extending between and fluidly coupling the forward part of the cooling passage and the exhaust channel formed in one of the two opposing slash faces; and a second conduit extending between and fluidly coupling the forward part of the cooling passage and the exhaust channel formed in the other of the two opposing slash faces, opposite the first conduit.

17. The turbine system of claim 15, wherein the unitary body for each of the plurality of turbine shrouds further includes at least one of:

a second cooling passage extending within the unitary body adjacent the forward end of the seal portion, the second cooling passage in direct fluid communication with the forward part of the first cooling passage, or a third cooling passage extending within the unitary body adjacent the aft end of the seal portion, the third cooling passage in direct fluid communication with the aft part of the first cooling passage.

18. The turbine system of claim 17, wherein the unitary body for each of the plurality of turbine shrouds further includes:

a first conduit extending between and fluidly coupling the second cooling passage and the exhaust channel formed in one of the two opposing slash faces; and a second conduit extending between and fluidly coupling the second cooling passage and the exhaust channel formed in the other of the two opposing slash faces, opposite the first conduit.

19. The turbine system of claim 17, wherein the unitary body for each of the plurality of turbine shrouds further includes:

a first rib formed in the seal portion, the first rib positioned between and separating the at least one plenum and the first cooling passage; and at least one of:

a second rib formed adjacent the forward end of the seal portion, the second rib positioned between and separating the forward part of the first cooling passage and the second cooling passage, or a third rib formed adjacent the aft end of the seal portion, the third rib positioned between and separating the aft part of the first cooling passage and the third cooling passage.

20. The turbine system of claim 19, wherein the unitary body for each of the plurality of turbine shrouds further includes:

a first plurality of impingement openings formed through the first rib to fluidly couple the first cooling passage to the at least one plenum; and at least one of:

a second plurality of impingement openings formed through the second rib, the second plurality of impingement openings fluidly coupling the forward part of the first cooling passage and the second cooling passage, or a third plurality of impingement openings formed through the third rib, the third plurality of impingement openings fluidly coupling the aft part of the first cooling passage and the third cooling passage.

* * * * *